US012538953B2

(12) United States Patent
Sherts

(10) Patent No.: US 12,538,953 B2
(45) **Date of Patent: *Feb. 3, 2026**

(54) REDUCED FABRIC OUTDOOR PROTECTIVE GARMENT-LIKE DEVICE

(71) Applicant: Charles R. Sherts, Westport, CT (US)

(72) Inventor: Charles R. Sherts, Westport, CT (US)

( * ) Notice: Subject to any disclaimer, the term of this patent is extended or adjusted under 35 U.S.C. 154(b) by 28 days.

This patent is subject to a terminal disclaimer.

(21) Appl. No.: 17/934,779

(22) Filed: Sep. 23, 2022

(65) Prior Publication Data

US 2023/0122354 A1 Apr. 20, 2023

Related U.S. Application Data

(63) Continuation-in-part of application No. 16/886,667, filed on May 28, 2020, now Pat. No. 11,528,949.

(60) Provisional application No. 62/854,299, filed on May 29, 2019.

(51) Int. Cl.

| | |
|---|---|
| ***A41D 31/06*** | (2019.01) |
| ***A41D 31/10*** | (2019.01) |
| *A41D 3/08* | (2006.01) |

(52) U.S. Cl.

CPC ..... *A41D 31/06* (2019.02); *A41D 31/10* (2019.02); *A41D 3/08* (2013.01)

(58) Field of Classification Search

CPC ..... A41D 2300/32; A41D 3/08; A41D 1/14; A41D 7/008; A41D 13/04; A41D 15/002; A47G 9/064; A41F 9/00

See application file for complete search history.

(56) References Cited

U.S. PATENT DOCUMENTS

| | | | | |
|---|---|---|---|---|
| 344,606 A * | 6/1886 | Town | A41D 3/08 2/88 |
| 774,452 A * | 11/1904 | Rathshuler | A41D 3/08 2/88 |
| 884,185 A * | 4/1908 | Mayper | A41D 3/08 2/76 |

(Continued)

FOREIGN PATENT DOCUMENTS

| | | | |
|---|---|---|---|
| GB | 2536563 A * | 9/2016 | A41D 7/008 |

*Primary Examiner* — Alissa L Hoey

(74) *Attorney, Agent, or Firm* — Anthony H. Handal; Handal & Morofsky LLC

(57) ABSTRACT

A protective device for maintaining body temperature in a living being is provided. The inventive protective device comprises a first sheet member having a left portion and a right portion. The first sheet member has a left edge and a right edge. A first channel member defines structure defining a first channel. The first channel member defines structure which is secured to and overlies a first portion of the left portion of the first sheet member and overlies a first portion of the right portion of the first sheet member. A second channel defining structure defines a second channel, the second channel defining structure secured to and overlying a second portion of the left portion of the first sheet member and overlying a second portion of the right portion of the first sheet member. Each of the channels have a first side and an opposite side opposite the first side. A variable length member is disposed on and extends along the length of each of the channels. There is a connection structure positioned proximate the left edge; and a mating connection structure positioned proximate the right edge.

2 Claims, 15 Drawing Sheets

(56) References Cited

U.S. PATENT DOCUMENTS 887,610 A * 5/1908 Epstein et al. ..... A41D 1/21 2/221
1,309,537 A * 7/1919 Miller ..... A41D 3/08 D2/823
2,099,110 A * 11/1937 Green ..... A41B 9/14 2/237
2,105,787 A * 1/1938 Herpich ..... A41D 1/14 D6/593
2,236,636 A * 4/1941 Louise ..... A41D 1/06 D2/742
2,260,427 A * 10/1941 Bailey ..... A41D 15/002 2/94
2,420,344 A * 5/1947 Verna ..... A47K 10/02 D2/714
2,626,648 A * 1/1953 Anderson ..... A45C 9/00 15/210.1
3,590,864 A * 7/1971 Vechesloff ..... A45F 4/02 135/96
3,801,986 A * 4/1974 Purdon ..... A41D 1/082 2/69
3,968,803 A * 7/1976 Hyman ..... A61F 13/145 602/61
4,180,867 A * 1/1980 Ridgeway, Jr. ..... A45F 4/02 135/96
4,484,362 A * 11/1984 Asher ..... A45F 3/22 5/413 R
4,644,589 A * 2/1987 Pettis ..... A41D 13/129 2/403
4,811,429 A * 3/1989 Perez ..... A41B 13/06 2/70
4,856,912 A * 8/1989 Damus ..... A45F 4/02 33/270
4,914,756 A * 4/1990 Grassick ..... A41D 13/129 2/238
4,937,885 A * 7/1990 Gregg ..... A42B 1/041 2/209.12
5,031,247 A * 7/1991 Carter ..... A41D 17/00 2/919
5,097,535 A * 3/1992 Dye ..... A41D 13/1236 2/104
5,127,108 A * 7/1992 Weiss ..... A41D 1/06 2/221
5,315,716 A * 5/1994 Baum ..... A41D 1/06 2/912
5,463,783 A * 11/1995 Pope ..... A45F 4/02 2/88
5,611,082 A * 3/1997 Bull ..... A41D 13/00 2/79
5,611,087 A * 3/1997 Adkins ..... A41D 13/1236 2/919
5,622,300 A * 4/1997 Robinson ..... A45C 3/10 224/586
6,243,873 B1 * 6/2001 Aliff ..... A41D 15/04 2/87
6,275,993 B1 * 8/2001 McCarley ..... A41D 15/04 2/84
6,393,637 B1 * 5/2002 Hoffman ..... A41D 15/04 5/413 R
6,408,462 B1 * 6/2002 Moore ..... A45F 4/02 2/84
D624,282 S * 9/2010 Clements ..... D2/860
D626,722 S * 11/2010 Macke ..... D2/823
7,950,070 B2 * 5/2011 Beven ..... A41F 9/00 2/237
8,464,374 B1 * 6/2013 Thayer ..... A45F 4/12 5/413 R
D712,629 S * 9/2014 Hilaire ..... D2/826
D712,630 S * 9/2014 Jones ..... D2/826
9,101,509 B2 * 8/2015 Rogers ..... A61F 15/004
D742,098 S * 11/2015 Pham ..... D2/826
9,226,626 B2 * 1/2016 Sprague ..... A47K 10/02
D751,274 S * 3/2016 Moore ..... D2/742
9,271,532 B2 * 3/2016 Cole ..... A41D 1/089
9,648,917 B2 * 5/2017 Griffith ..... A41D 1/08
10,080,391 B2 * 9/2018 Rundle ..... A41D 3/08
D863,726 S * 10/2019 Dodd ..... D2/719
10,736,797 B1 * 8/2020 Braun ..... A41D 15/002
10,779,584 B1 * 9/2020 Smith ..... A41D 1/14
11,096,433 B2 * 8/2021 Kim ..... A61F 5/03
D932,739 S * 10/2021 Bain ..... D2/826
11,154,103 B2 * 10/2021 Sposito ..... A41F 9/00
11,490,696 B2 * 11/2022 Harris ..... A44B 19/32
11,503,867 B2 * 11/2022 Pérez ..... A41D 15/02
11,528,949 B2 * 12/2022 Sherts ..... A47G 9/066
11,723,418 B2 * 8/2023 Scott ..... A41D 13/00 2/59
11,930,868 B2 * 3/2024 Zlotkin ..... A47G 9/064
2005/0044606 A1 * 3/2005 Flanagan-Frazier ... A41D 7/006 2/69
2007/0017000 A1 * 1/2007 Segal ..... A41D 7/006 2/69
2007/0289061 A1 * 12/2007 Dumoulin ..... A41D 7/008 2/69.5
2008/0078027 A1 * 4/2008 Smith ..... A41D 15/04 5/413 R
2008/0271222 A1 * 11/2008 Nienow ..... A47G 9/064 2/311
2010/0199402 A1 * 8/2010 Curtis ..... A47G 9/064 2/69
2011/0179548 A1 * 7/2011 Weston ..... A41D 3/08 2/84
2011/0258749 A1 * 10/2011 Hibbs ..... A41D 15/04 2/84
2011/0305866 A1 * 12/2011 Stowe ..... A47K 10/02 428/100
2012/0311763 A1 * 12/2012 King ..... A41D 3/00 2/87
2013/0074247 A1 * 3/2013 Gernes ..... A41F 9/00 2/321
2014/0338101 A1 * 11/2014 Moore ..... A41D 1/06 2/237
2015/0245676 A1 * 9/2015 Carryl ..... A41D 13/129 2/69
2016/0021943 A1 * 1/2016 Das ..... A41D 1/14 2/219
2016/0192719 A1 * 7/2016 Chrzanowska ..... A47K 10/02 2/74
2018/0213952 A1 * 8/2018 Penn ..... A47G 9/064
2019/0246712 A1 * 8/2019 Sonksen ..... A47G 9/064
2019/0254410 A1 * 8/2019 DuVall ..... A41D 3/08
2019/0328059 A1 * 10/2019 Chang ..... A41D 13/08
2021/0345787 A1 * 11/2021 Aggarwal ..... A61G 7/1051
2021/0378427 A1 * 12/2021 Isabelle ..... A41D 13/05
2022/0287390 A1 * 9/2022 Revankar ..... A41D 1/22

* cited by examiner

REDUCED FABRIC OUTDOOR PROTECTIVE GARMENT-LIKE DEVICE

CROSS REFERENCE TO RELATED APPLICATION

This application claims the benefit of Provisional Patent Application No. 62/854,299, filed May 29, 2019 entitled Portable Protective Device, and U.S. Non-Provisional application Ser. No. 16/886,667 entitled Outdoor Protective Garment-Like Device, the disclosures of which are hereby incorporated by reference.

TECHNICAL FIELD

The present invention relates to outdoor protective clothing.

BACKGROUND OF THE INVENTION

Although some companies sell warm weather wraps for withstanding cold and windy weather while in an outdoor stadium, these can be ineffective in relatively cold weather and cumbersome during transport. Wraps also often only offer partial coverage and fall off when the wearer is standing up or moving, unless the wearer takes steps to hold them in place, for example by tightening an edge around the body and holding it against itself. Also, blankets generally do not offer protection from any of the elements, such as rain or snow.

While protective devices such as ponchos, do stay in place, they offer limited protection and, except in the head area, provided that a hood with a tightening mechanism is included, are relatively ineffective.

SUMMARY OF THE INVENTION

There is a need for an improved covering that better protects the wearer from the cold weather. A solution to the problem of an easier method of transporting the protective device would also be desirable. These are provided by the present invention. The inventive protective device provides an integral pocket. Moreover, attachments are provided at the peripheral edges of the inventive protection device to ensure that it remains in place during movement. Thus, the present invention meets the above and other needs.

Generally, the inventive device comprises an insulative pliable sheet of material dimensioned to be wrapped around the human body and incorporating structure for securely closing around the body. The insulative pliable sheet is provided with elastic members to allow it to be snuggly disposed around the body of the user. The insulative pliable sheet has a small dimension at the bottom of the insulative pliable sheet as compared to the top of the insulative pliable sheet.

A corner fastener may be disposed proximate a lower corner of the device, and a mating fastener secured and disposed at a higher position on the device. The mating fastener mates with the corner fastener, allowing a corner of the wrap to be pulled up for freedom of movement and/or ventilation.

The device may further comprise a second corner fastener disposed proximate a second lower corner of the device, with the second corner fastener mating with said mating fastener secured and disposed at the higher position on the device.

Optionally, the insulative pliable sheet of material may have a waterproof or water resistant outside surface, and an additional mating corner fastener.

In accordance with the invention, a protective device for maintaining body temperature in a living being, such as a human, is provided. The inventive protective device comprises a first sheet member having a left portion and a right portion. The first sheet member has a left edge and a right edge. A first channel member defines structure defining a first channel. The first channel member defines structure which is secured to and overlies a first portion of the left portion of the first sheet member and overlies a first portion of the right portion of the first sheet member. A second channel defining structure defines a second channel, the second channel defining structure secured to and overlying a second portion of the left portion of the first sheet member and overlying a second portion of the right portion of the first sheet member. Each of the channels have a first side and an opposite side opposite the first side. A variable length member is disposed on and extends along the length of each of the channels. There is a connection structure positioned proximate the left edge; and a mating connection structure positioned proximate the right edge.

The first and second channel defining structures are secured to and extend from the left portion of the first sheet member, and are secured to and extend from the right portion of the first sheet member. The first and second channel defining structures each comprise a continuous structure extending from the left portion of the first sheet member to the right portion of the first sheet member.

The first and second channels may be defined between (i) a second sheet member; (ii) the first sheet member, the second sheet member being in facing relationship to the first sheet member; (iii) an elongated first area of attachment extending along the first side of each of the channels; and (iv) an elongated second area of attachment extending along the first opposite side of each of the channels. The first sheet member may comprise a flat planar member or a textile material. The first sheet member may also be insulative and the second sheet member may be substantially waterproof or water resistant. Each of the variable length members may comprise an elastic member or a slidably mounted cord and length reducing structure.

Each of the variable length members may comprise an elongated cord and at least one catch member for shortening the available length of cord in its respective channel, whereby, when the protective device is wrapped around the body and the cord tightened, the protective device takes a tubular configuration. The circumference is that smaller than the length of the cord and snuggly grips the body.

The channel defining structures may comprise a continuous elongated member extending from the left portion of the first sheet member to the right portion of the first sheet member and the sheet may be configured and dimensioned to be wrapped around a human body.

The inventive protective device may comprise a third channel defining structure defining a third channel and an additional variable length member disposed in the third channel. In principle, additional channel defining structures and variable length members may also be provided. The connection structure may be a loop connection structure and the mating connection structure may be a hook connection structure. The hook connection structure may be of the type more likely to connect only to mating loop material, and not other fabric and materials in the environment.

In accordance with the invention, it is recognized that convective heat transfer is governed by:

$Q=h_c Adt$, where q is the heat transferred per unit time (W, Btu/hr), A is the heat transfer area of the surface ($m^2$, $ft^2$), $h_c$ is the convective heat transfer coefficient of the process ($W/(m^2K)$ or $W/(m^{2\circ}$ C.), Btu/($ft^2$ h° F.)), and dT is the temperature difference between the surface and the bulk fluid (K or ° C., F).

As air flow changes (wind speed) changes from low to moderate the heat transfer coefficient changes by tenfold. In accordance with the invention it has been recognized that this means the convective heat loss from the body is ten times more with a moderate wind versus a low wind speed.

On a cool, cold, or rainy day a person exposed to the elements will suffer from heat losses associated with convection, conduction, and radiation. Convective heat loss is the body's exposure to cooler moving air. Conductive heat loss is from direct contact with a colder solid more fluid which acts as a heat sink. This could be air which is not moving or it could be an object such as an aluminum bench. Radiation heat losses follow from the body giving off infrared radiation that are dissipated into the air.

The present invention is directed toward the minimization of heat transfer from the body taking advantage of the thermodynamics and physics to essentially eliminate convective heat loss from the human body. By adjusting the air velocity and exposed surface area, the body's heat loss and warmth retention can be adjusted.

Convective heat loss is transfer of heat by the movement of air or water against the body. The body warms the boundary layer of air or water next to the skin by conduction. Movement of the air or water disrupts the boundary layer carrying away the warm boundary layer of air and replacing it with colder air or water, thus maintaining the difference between ambient temperature in the body and exacerbating the loss of body warmth. The amount of heat carried away is relative to the surface area, the wind velocity and the temperature differential.

Since the heat transferred is a multiple of surface area, temperature differential and velocity of the air and the lower body is over 40% of the human body, the lower body loses a large amount of heat to convective heat loss.

The advantage of the invention compared to existing products is essentially elimination or at least drastic minimization of convective heat loss, a major source of heat loss on a cool breezy day.

Thus, the present invention has as its object forming an essentially sealed tubular structure to prevent air movement and convective heat loss from the sides. Structure is provided which essentially seals the top and bottom of the tubular structure against the body preventing air movement and convective heat transfer (loss) from the ends of the tubular structure. In accordance with the invention, elastic members the hold the blanket tight against the body for essentially the entire length of the tubular structure preventing air movement and convective loss within the tubular structure.

At the same time the inventive structure elastically conforms to the human body to allow free movement and flexing such as sitting and standing.

It is preferred that the inventive stadium wrap or covering have an external barrier comprised of a tightly woven flexible fabric such as nylon or polyester that blocks wind and air movement from the outside. Likewise, an external moisture/rain/snow barrier comprised of a flexible tightly woven fabric or one that is coated with a water repelling component such as polyurethane is provided in accordance with a preferred embodiment.

An inner layer, made of fleece, artificial fur, or the like, acts as a conductive and convective heat loss prevention member. It is typically a fibrous flexible fabric such as fleece material made from polyester. It could also be a high loft light weight material such as goose down in nylon fabric pockets. The use of nylon cords create a larger barrier to conductive and convective heat loss due to the convolutions of the insulating layers creating undulations as the elastics within the fabric layers are tightened. The undulations create a thicker barrier of insulating material between the body and the outside air or cold structure such as a stadium bench. The product can be closed to any length along the edge of the tube to allow any amount of airflow or warming desired. For example at the beginning of use it could be closed around the waist only, providing a minimal amount of warmth and as the weather gets colder the tube could be closed further down the edge towards the feet. Then as it gets even colder, the product can be closed down to the ankles and tightened to bring it in contact with the body to provide the warmest protection.

In accordance with the invention, the tightness of the product at the ankles can be adjusted to vary the air entering the bottom of the tube formed by the inventive wrap. The less air entering, the warmer it will be. You can also be used with almost any late forming a tube and the rest open. Likewise, the wrap can be adjusted for snugness around the length of the tube by adjusting and changing the circumference of the tube which open or closes the interior voids where bigger voids allow more airflow and heat loss. This is accomplished by a narrow strip of hook attachment material which can be positioned at any point along the width of a wider, for example 1 foot wide, strip of loop attachment material.

Sealing is provided by elastics, such as an elastic cord member, at the top and bottom of the of the tube close and seal the ends of the tube around the waist and feet preventing wind and outside airflow to entering the tube. The objective of the inventive structure is to seal the tube completely from the top to the bottom of the inventive stadium wrap and thus minimize the effects of wind.

A body covering device accommodating a range of user body sizes and proportions is disclosed. The device comprises a planar member having an inside surface and an outside surface. The inside surface has a waterproof or water resistant characteristic and the planar member has an insulative characteristic. The planar member comprises a waist portion adjacent an upper edge of the body covering device. The planar member is fabricated from a sheet of material having an uncompressed length at the upper edge, an ankle portion adjacent to the lower edge of the body covering device; and a knee portion disposed between the waist portion and the ankle portion. The planar member defines first and second side edges extending in the direction from the upper edge and the lower edge. The lower edge is substantially smaller than the upper edge. The first side edge gradually tapers the width of the planar member in the direction toward the bottom edge. The second side edge extends substantially transverse to the upper edge for a distance between 40 and 60% of the distance between the upper edge and the lower edge in a non-tapering fashion adjacent the waist portion and a portion of the ankle portion. The second side edge extends toward the lower edge of the body covering device with an orientation which results in tapering the width of the body covering device in the region between the middle of the knee portion and the bottom of the ankle portion. The body covering device further comprises an elastic member positioned adjacent the upper edge of the body covering device. The elastic member being configured in a stretched configuration to over lie the uncompressed length of the upper edge. When the elastic member assumes an unstretched configuration it shortens the length of the upper edge to match a desired waist size for a user.

BRIEF DESCRIPTION OF THE DRAWINGS

The operation of the inventive stadium wrap will become apparent from the following description taken in conjunction with the drawings, in which.

DETAILED DESCRIPTION OF THE PREFERRED EMBODIMENT

Figure 1:
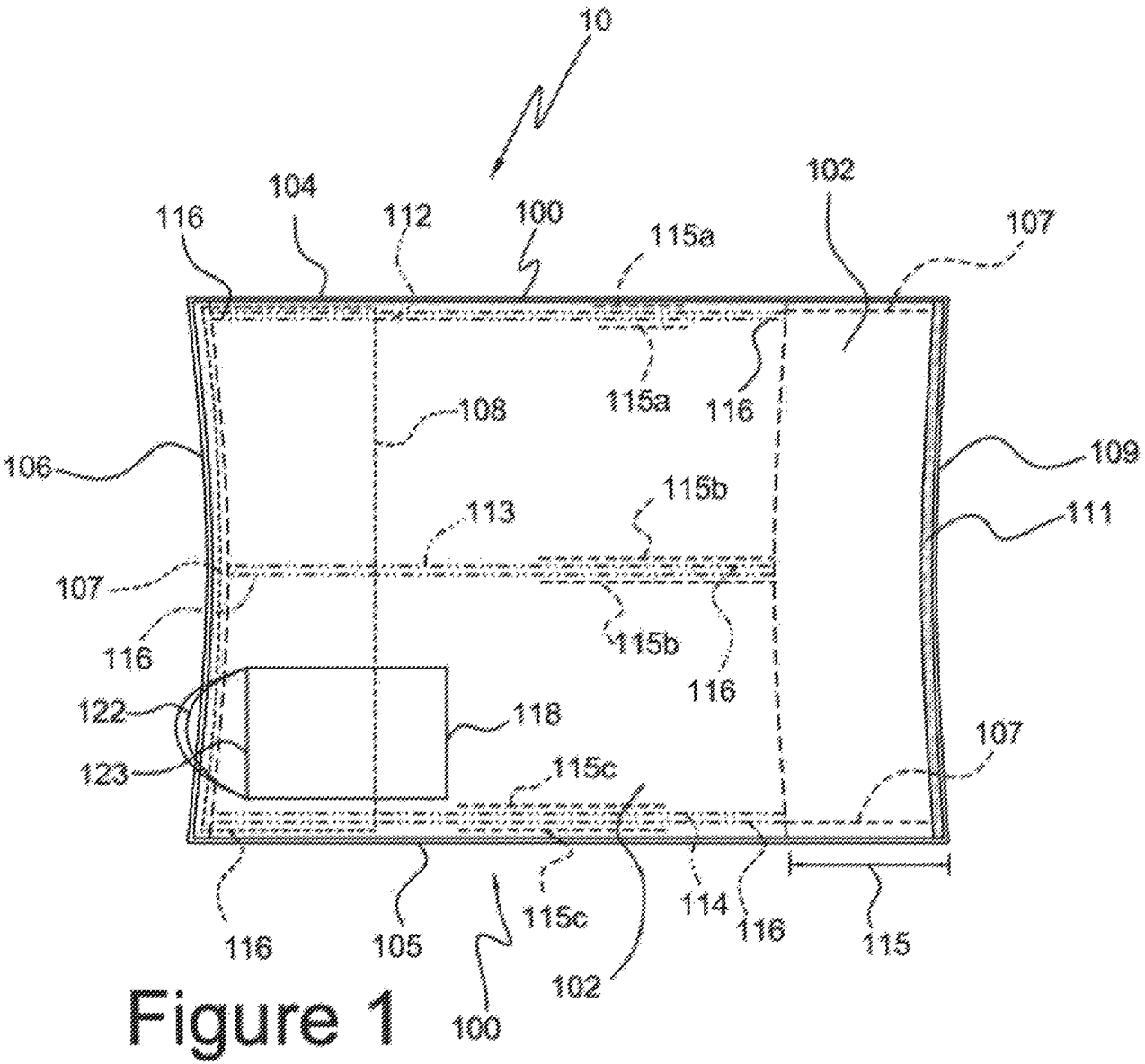
FIG. 1 is a bottom plan view of a preferred embodiment of the inventive protective device with the inside of the protective device exposed to view, and with the elastic tensioning members stretched to more accurately depict the rectangular shape of the fabric members which comprise the protective device, and with a pocket intended for use implementing convenient carrying of the inventive protective device.

For purposes of promoting an understanding of the principles of the invention, reference will now be made to the embodiments illustrated in the drawings and specific language will be used to describe the same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The word "exemplary" is used herein to mean "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined in the claims.

FIG. 1 is a bottom plan view of a preferred embodiment of the protective device 10 of the present invention, optionally taking the form of a stadium wrap 100. In this specification, the example of a stadium wrap 100 is given. In FIG. 1, stadium wrap 100 is pulled taut, as such, the stadium wrap is made of a material which is rectangular in shape but presents with a bit of an hourglass shape because of the action of elastic members as detailed below.

Moreover, it is to be understood that the inventive protective device may take other forms, for example, a blanket to be wrapped around athletes competing in a competition. Likewise, the inventive protective device 10 may take the form of a device to be worn during other activities which occur outdoors, such as camping, hiking, fishing, watching games which do not occur in a stadium (such as golf), attending an outdoor concert or other event, and so forth. Likewise, it is contemplated that when not worn, the inventive protective device 10 may be used like a conventional blanket, or be wrapped around the body and secured in place without tension. FIG. 1 illustrates the inside of stadium wrap 100, that is that portion of wrap 100 that faces the body of the user when worn.

In the illustrated embodiment, stadium wrap 100 comprises multiple layers including an inner layer 102 which may be made of any comfortable suitable fabric 102, such as fleece, cotton flannel, or linen. One of the layers is desirably provided with a thermal characteristics which causes it to function as an insulator. For example, inner layer 102 may be an insulative textile fabric to increase warmth of a wearer. In accordance with the preferred embodiment, inner layer 102 has a face 102*a* which is comfortable when worn in contact with the skin. For example, face 102*a* may be fleece, cotton flannel or linen.

In accordance with a preferred embodiment of the invention, the inventive stadium wrap 100 includes a second layer which may take the form of a weather protection fabric 103, such as a textile material which has been treated with a waterproofing compound. Alternatively, or in addition, any waterproof material may be used, such as vinyl or vinyl coated textile. Still yet another alternative is the interposition of a waterproof material between layers 102 and 103, for example a waterproof material which breathes (for example polymeric material), such as Gortex™ material. In accordance with the invention, fabric layer 103 overlies and is in facing relationship to inner layer 102. Layers 102 and 103 form opposite sides of the inventive stadium wrap 100. Weather protection fabric 103 may be any one of numerous materials which will provide protection from wind, water and other environmental conditions. For example, tightly folded parachute nylon fabric which has been treated with a waterproofing agent will effectively block wind, air leakage during movement, and water.

In accordance with the preferred embodiment, all of the layers which comprise inventive wrap 100 are, optionally, made of breathable material to promote comfort without allowing cold or wind to penetrate.

Optionally, inventive stadium wrap 100 may take a wide range of sizes and shapes. For example, a height of 1 m and width of 1.2 m will function well in a wide variety of circumstances, and for users having a range of different heights. In addition, the relatively large width allows the inclusion of elastic cords which effectively shorten the width of the stadium wrap, allowing it to snuggly extend around the user when in use, while providing insulative air pockets.

Optionally, a layer of water protective material, such as Gore-Tex™, may be introduced between weather protection fabric 103 and inner comfortable fabric layer 102. Optionally, an additional insulative material may also be introduced between weather protection fabric 103 and inner layer 102 for further protection against the cold.

Optionally, in accordance with the invention, a layer of reflective material may be provided.

In accordance with the invention, when the inventive stadium wrap 100 is being used, it is wrapped around the user. The inner layer 102 faces inward towards the user while stadium wrap 100 is in use. In its construction, inner layer 102 is secured to outer weather protection layer 103, for example by being sewn with cotton or cotton and nylon thread 107. Multiple rows of stitching may be employed.

Stadium wrap 100 has a top longitudinal edge 104 and a bottom longitudinal edge 105 that run parallel to one another and represent the outermost edge of inner layer 102 and outer layer 103. Perpendicular to top longitudinal edge 104 and bottom longitudinal edge 105 is outermost left edge 106 and outermost right edge 109. Left edge 106 and right edge 109 represent the outermost height of wrap 100 and its inner layer 102 and outer layer 103.

Top longitudinal edge 104, bottom longitudinal edge 105, left edge 106, and right edge 109 are bound together by stitching as noted above. The result is that inner layer 102 and outer layer 103 are securely positioned with respect to each other, by being bound with, for example, a running stitch or a binding stitch 107.

Along left edge 106 is a wide patch of hook fastener material 108 (secured to the outside of layer 103) that mates with loop fastener material 111 positioned adjacent right edge 109 and configured as a narrow strip and sewn to inner layer 102. Connection of material 108 to fastener material 111 is done at a position which results in stretching elastic cord members as described more fully below, thus resulting in a snug fit. This allows right edge 109 to be connected adjacent left edge 106. Thus, the stadium wrap 100 is attached to the user securely disposed around the user, when the user stands, sits, or is in motion. Hook and loop fastener materials 108 and 111 may comprise material of the sort sold under the Velcro trademark.

Alternatively, in place of hook and loop fasteners, other types of fasteners may be used, more particularly any fastener that will allow a user to partially or fully enclose stadium wrap 100 around the body, such as Velcro™ fastener material or a slidingly engaging fastener, such as a sewn on metal hook and a metal loop, or a plurality of the same. In accordance with the preferred embodiment, the strip of loop material is much wider than the strip of hook material thus allowing selective closing of the inventive stadium wrap with varying degrees of tightness.

Figure 2:
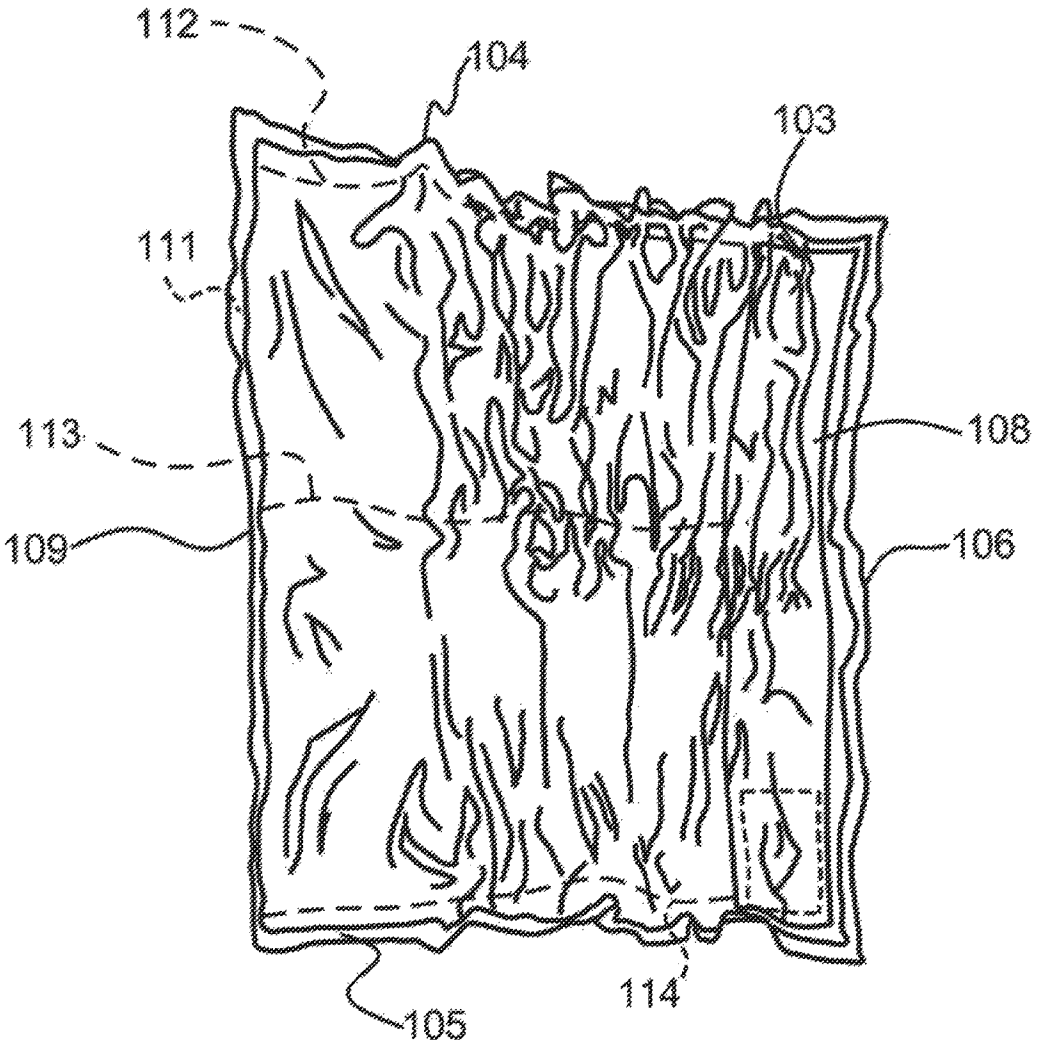
FIG. 2 is a top plan view of the embodiment of FIG. 2 with the weather proof outside surface exposed to view, and with the tensioning members in an unstretched configuration.

Hook and loop fastener materials 108 and 111 are optionally, but preferably, configured to fasten along the entire left and right edges of left connecting edge 106 and the right edge 109, as illustrated in FIGS. 1 and 2, where it can be seen that the hook and loop fastener materials 108 and 111 extend from the top edge 104 to the bottom edge 109.

Figure 3:
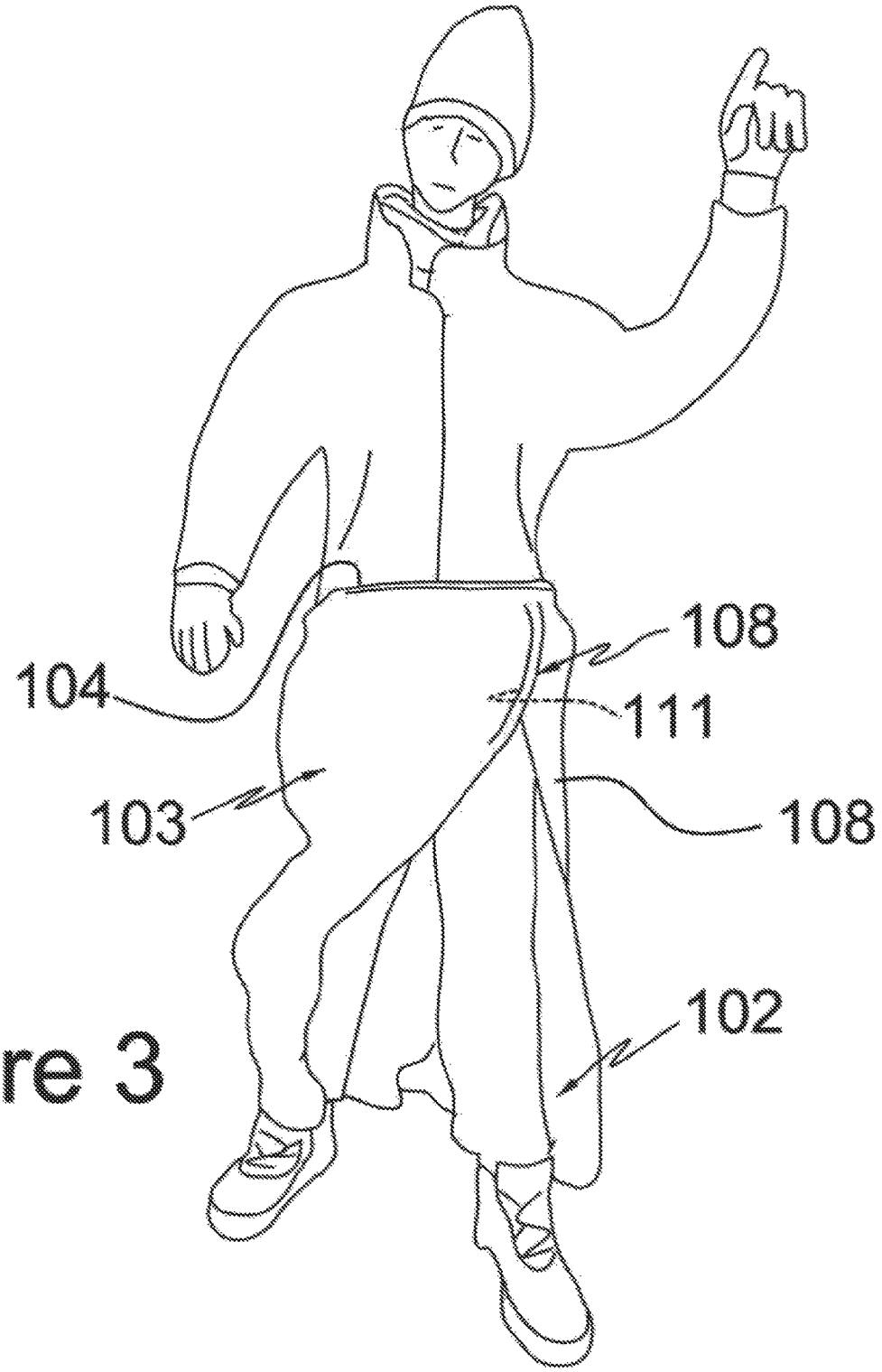
FIG. 3 is a front elevation view of a preferred embodiment of the invention being worn by a user as a wrap over the bottom of a jacket and partially enclosing the user, more particularly with an elongated open bottom portion to permit walking and running.

However, the embodiment illustrated in FIGS. 1 and 2 may be used to connect partially along the length of the right and left edges, allowing for greater movement of the user's legs while wearing stadium wrap 100 (as shown in FIG. 3). This may be achieved by simply not engaging the hook fastener material with the loop fastener material. See for example FIG. 3, where the user is seen walking or running with plenty of room for unconstricted leg movement.

Stitched in between inner layer 102 and outer layer 103 are three elastic cords 112-114, whose function is to allow the width of the inventive stadium wrap 100 to be varied from full width, for example 1.2 meters, to a smaller width substantially equal to the width of the elastic cords plus the width 115 of the non-elastic portion of stadium wrap 100. More particularly, in accordance with the invention a top elastic cord 112, a middle elastic cord 113, and a bottom elastic cord 114 are provided.

Top elastic cord 112 runs parallel with top longitudinal edge 104. Top elastic cord 112 lies closer to top longitudinal edge 104 than to middle elastic cord 113. Middle elastic cord 113 lies roughly in the middle of inner layer 102 and outer layer 103 and runs parallel to top longitudinal edge 104 and bottom longitudinal edge 105. Middle elastic cord 113 may be positioned closer to bottom elastic cord 114 than top elastic cord 112. Bottom elastic cord 114 runs parallel to bottom longitudinal edge 105. Bottom elastic cord 114 lies closer to bottom longitudinal edge 105 than to middle elastic cord 113. Top elastic cord 112, middle elastic cord 113, and bottom elastic cord 114 are long enough to result in stadium wrap 100 extending around and snugly gripping the user, optionally, a user of very petite or skinny stature.

Elastic cords 112, 113 and 114 are slidably mounted within the elongated channels defined between facing stitching pairs 115 *a-c*. Stitching 115 *a-c* is of any length and width necessary to secure top elastic cord 112, middle elastic cord 113, and bottom elastic cord 114 in place. See FIG. 7.

Top elastic cord 112, middle elastic cord 113, and bottom elastic cord 114 are comprised of material that will elastically expand under the application of tension and contract to its original shape when the tension is released. Such elasticity is provided in order to enable the three elastic cords to secure stadium wrap 100 securely and comfortably snug around the user. Elastic cords 112 are any diameter necessary to rest slidably within channels defined between stitching pairs 115 *a-c*. Elastic cords 112 are thus held in place by stitching pairs 115 *a-c*.

The ends of elastic cords 112, 113 and 114 are secured to the inside layer 102 and outside layer 103 by tacking threads 116. Accordingly, tightly wrapping stadium wrap 100 around the body of the user puts elastic cords 112, 113 and 114 in tension.

Elastic cords 112 prevent heat loss by keeping stadium wrap 100 closer to the user. The result is a smaller air gap between the user and the inside of wrap 100. This reduces heat loss caused by air convection in the space between the user and wrap 100. At the same time, while ruffles are formed, these ruffles tend to form independent and smaller compartments which are not in substantial convective communication with the user's body, and thus act as insulative ruffle pockets. These ruffle pockets effectively thicken the insulative material and the protective nature of the inventive stadium wrap. The combination of these effects results in substantial protection from the cold.

Figure 4:
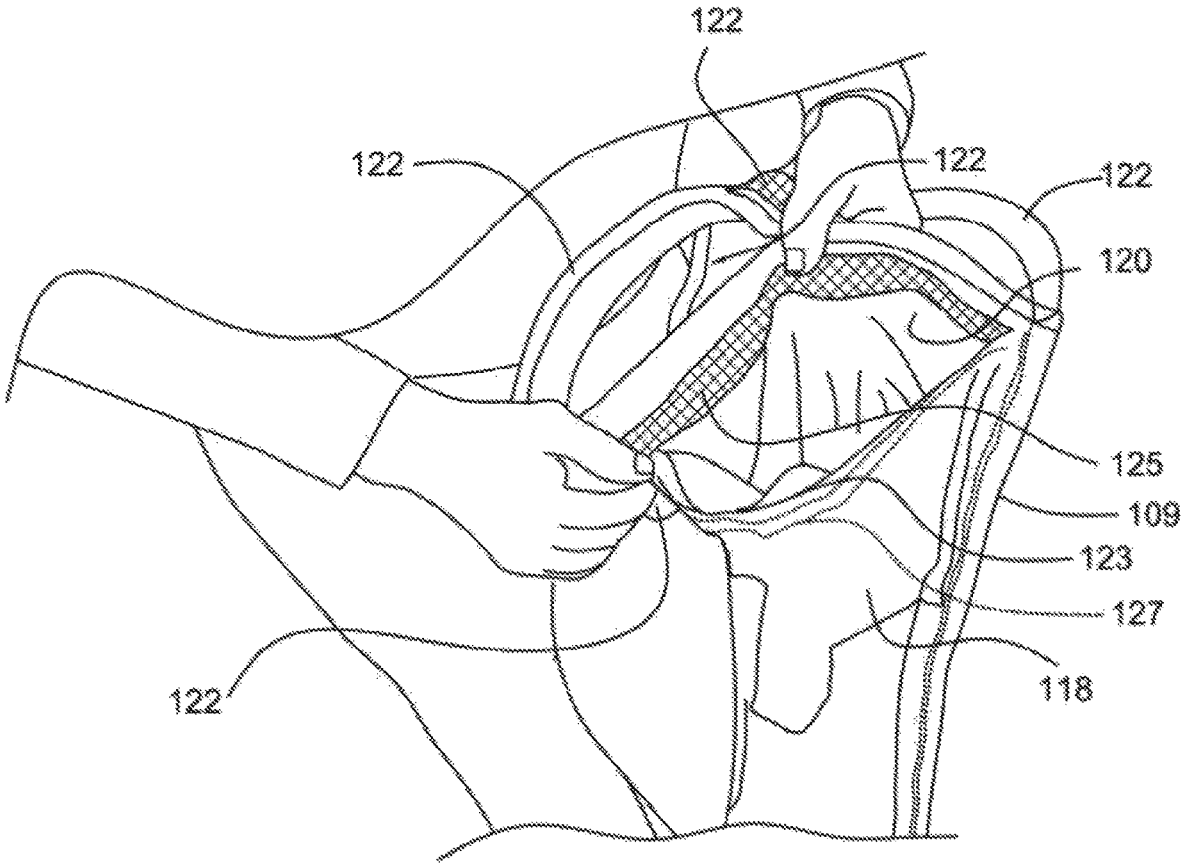
FIG. 4 is a perspective detailed view showing the construction of the dedicated pocket intended to be turned inside out for use implementing convenient carrying of the inventive protective device.
Figure 5:
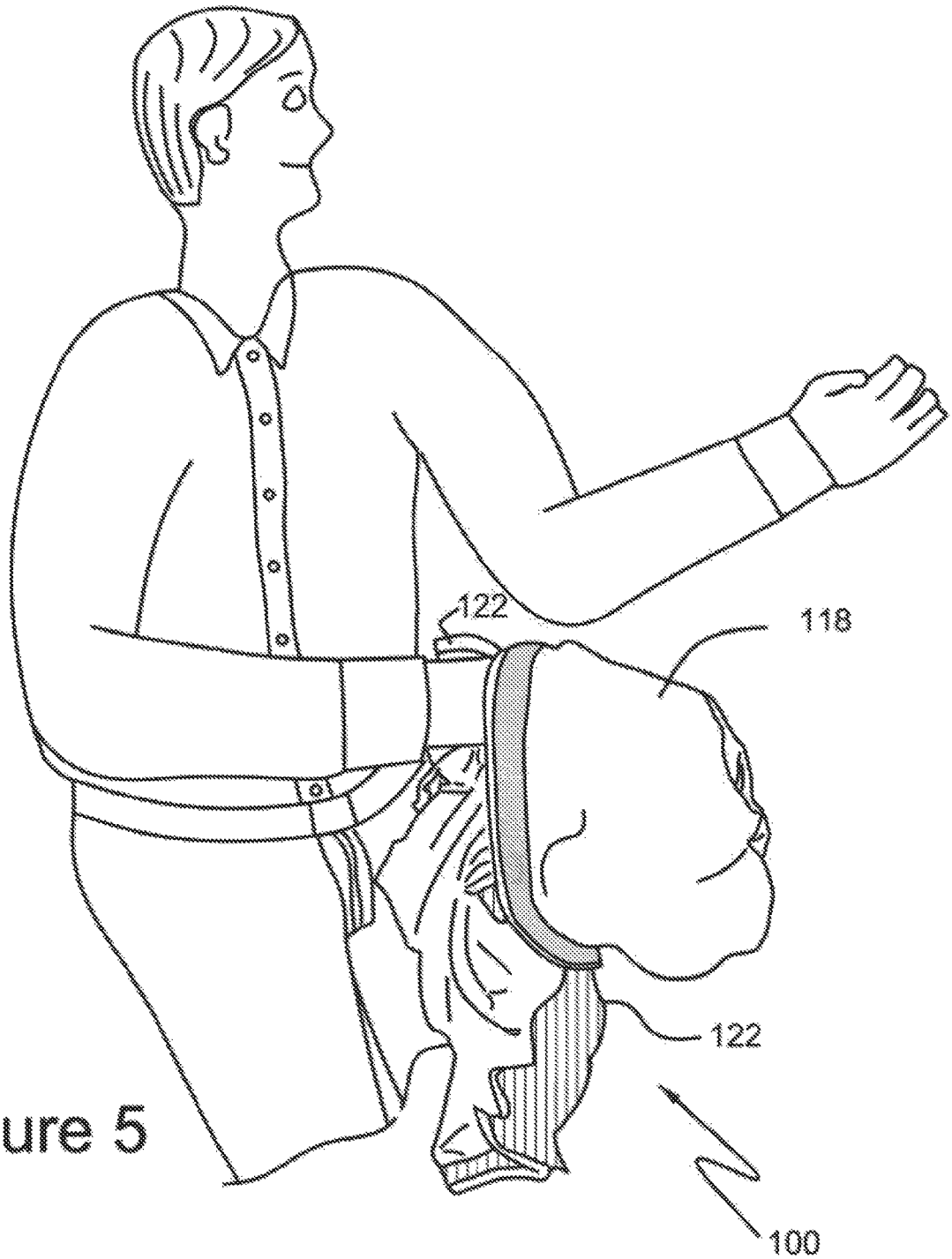
FIG. 5 is a perspective view showing the embodiment of FIG. 1 in use with the body of the protective device being stuffed into the dedicated pocket after the pocket has been turned inside out.

As shown in FIGS. 1 and 4, a rectangular fabric panel 118 which defines a pocket and functions as a bag for containing the stadium wrap 100 is illustrated in FIG. 1. Fabric panel 118 defines a pocket 120. A single handle 122 is secured adjacent opening 123 of pocket 120. In the packed position of wrap 100, fabric pocket 120 defined by fabric panel 118 fully contains stadium wrap 100, into which it may be stuffed, as shown in FIG. 5 by turning pocket 120 inside out. Handle 122 may comprise any material suitable for a strap, such as textile fabric, leather or combinations thereof. The fabric bag formed by panel 118 may be closed by using hook and loop fastening materials 125 and 127. After stadium wrap 100 has been stuffed into the pocket as illustrated in FIG. 5, it may be easily carried using handle 122. Alternatively, a pair of handles may be used.

FIG. 2 is a top plan view of stadium wrap 100. Stadium wrap 100 is displayed in a natural state as longitudinal edges 104 are slightly compressed by elastic cords 112. The outside layer 103 of stadium wrap 100 may comprise weather protection fabric. The weather protection fabric may be any material suitable for repelling water and retaining heat.

FIG. 3 is a front elevation view of the preferred embodiment partially enclosing the user. Stadium wrap 100 is shown with the hook and loop fasteners 108 and 111 only partially engaged and the wrap thus partially closed. FIG. 3 illustrates the ease of movement, even during running, afforded by only partially closing hook and loop fasteners 108 and 111.

Figure 6A:
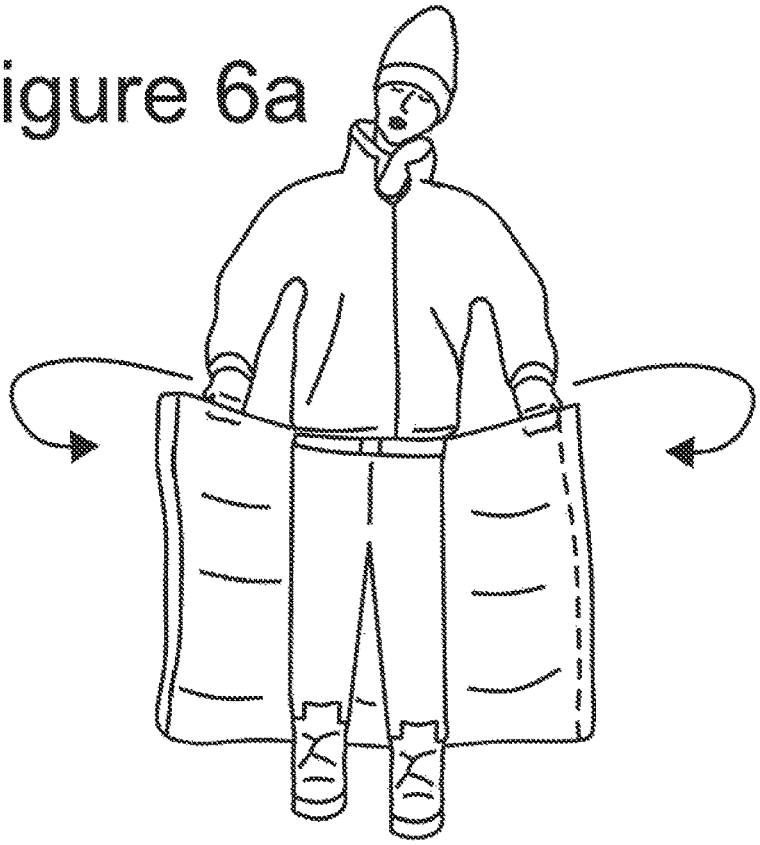
FIGS. 6*a* and 6*b* are views of the embodiment of FIG. 1, opened to be prepared for use and being worn under a jacket and configured partially open to permit walking and sitting.
Figure 6B:
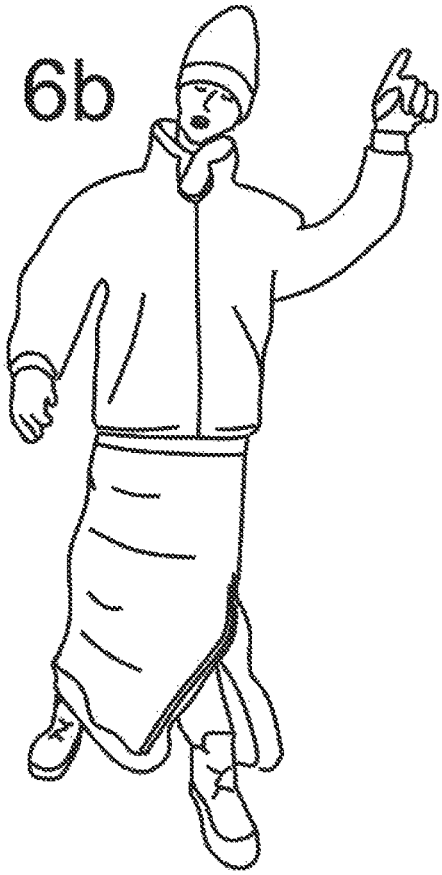

FIG. 6 shows a front elevation view of the preferred embodiment partially open, allowing some movement but still providing substantial protection, useful for walking a short distance or sitting. Alternatively, depending upon the shape of the user, the stadium wrap 100 may be expanded at any point along its height or restricted at any point along the height to accommodate different body types and shapes. The same is achieved through the use of a narrow engagement fabric strip 108 which may be positioned along any portion of a wide fabric engagement patch 111. In accordance with the preferred embodiment, the width of fabric engagement patch 111 is about 30 cm.

In accordance with the invention, the inventive stadium wrap 100 may be secured using the hook and loop fasteners in the position illustrated in FIG. 3 or FIG. 6, thus allowing for a stable wrap configuration suitable for either minimum movement or for more extreme movements such as running. If desired, clips or snaps may be provided in addition to the hook and loop fastener material.

FIG. 5 is a perspective view showing stadium wrap 100 being stuffed into fabric bag 118. Stadium wrap 100 may be folded in any manner that allows for convenient carry when completely folded into fabric bag formed by panel 118. The same may be achieved by randomly stuffing the planar portion of the stadium wrap into the bag formed by turning the pocket inside out. Alternatively, the body of the stadium wrap 100 may be folded carefully and slid into the pocket defined by panel 118, thus resulting in a relatively flat configuration. Still yet another alternative is to stitch a bag into the inside of wrap 100.

Figure 8:
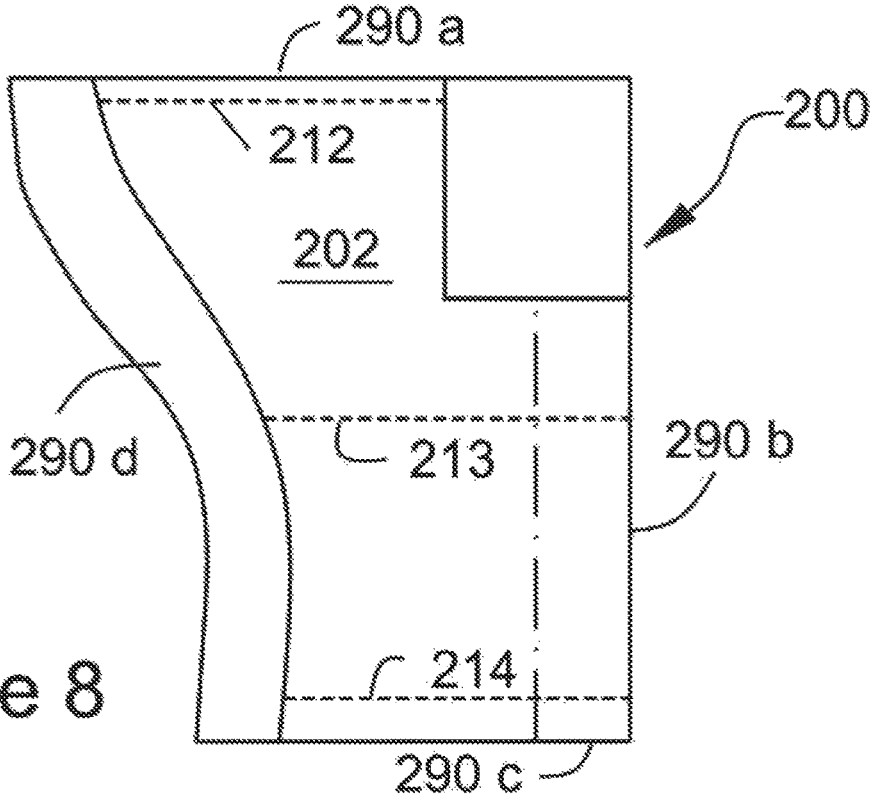
FIGS. 8 and 9 illustrate an alternative embodiment of the invention having a curved side which defines a tapered shape for accommodating the narrow girth of the legs of the user.

In another preferred embodiment, depicted in FIG. 8, an inventive stadium wrap 200 has an unsymmetrical shape. Stadium wrap 200 generally defines top side 290*a*, vertical side 290*b*, foot side 290*c*, and curved side 290*d*. In this embodiment sides 290*a* and 290*c* are approximately parallel and intersect side 290*b* at approximately a right angle. Additionally, side 290*a* is longer than side 290*c*. In an exemplary embodiment side 290*a* is 47 inches in length and side 290*c* is 35 inches in length.

It is additionally contemplated that sides 290*a* and 290*c* may be longer or shorter to accommodate different sizes of the stadium wrap to accommodate different sized people wearing the wrap and/or the use of the stadium wrap with other warm clothing for cold weather and/or different gate measurements. For example, side 290*c* of the stadium wrap may measure 28, 35, 45, or 52 inches and side 290*a* of the wrap may measure the same for all sizes or may change depending on the desired fit, by way of example side a may measure 47, 50, 60 or 70 inches.

Further, side 290*d* is configured to curve from the longer side 290*a* to the shorter side 290*c*. This curve may be a large s shape or a more gentle s shaped curve. The shape of side 290*d* is specifically designed to lay adjacent to the bodily curves of the wearer. As such, the curve of side 290*d* may change based on the size of the stadium wrap and it is specifically contemplated that the curve of side 290*d* would be shallower if side 290*a* measured 60 inches and side 290*c* measured 52, as compared to the configuration where side 290*a* measures 60 inches and side 290*c* measures 28 inches.

Figure 9:
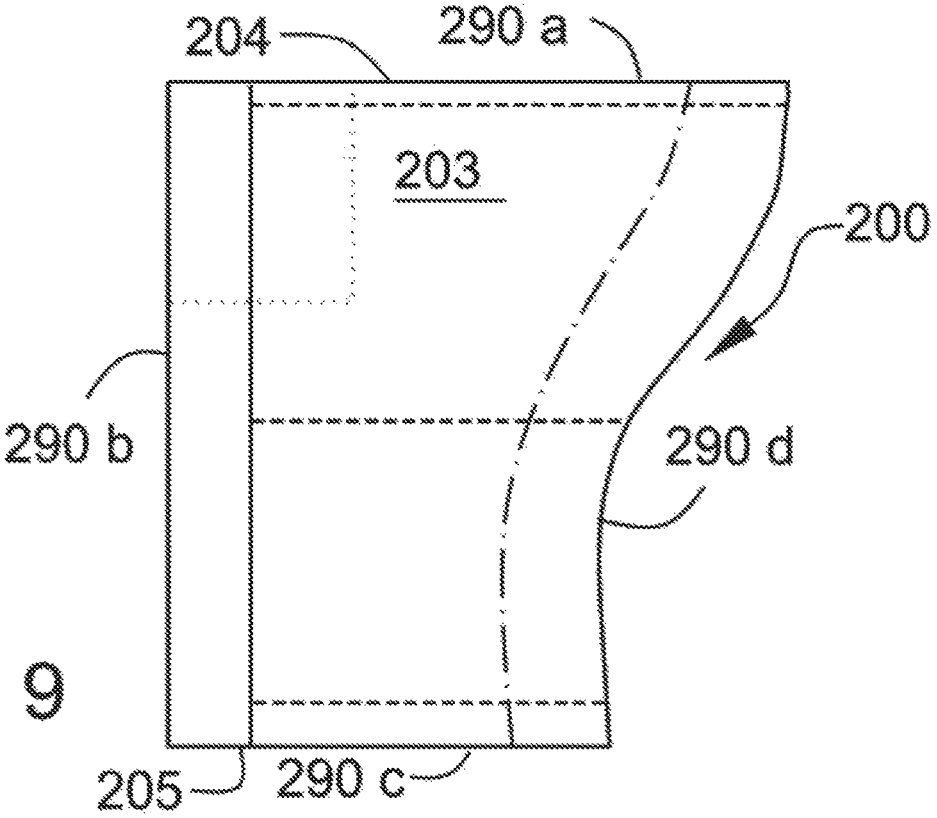

The stadium wrap of FIGS. 8-9 are composed of materials the same as those disclosed in reference to FIG. 1 above, or equivalent materials as are well known to those of ordinary skill in the art. Specifically, in an embodiment, the stadium wrap 200 comprises multiple layers including an inner layer 202 which may be made of any comfortable suitable fabric 202, such as fleece, cotton flannel, or linen. The inner layer is configured to increase warmth of a wearer and to be comfortable to be worn on the body. It is additionally contemplated that this fabric may be a light weight moisture wicking material designed to retain heat, light weight material with heat reflective properties or other light weight material that is specifically designed for warmth.

In accordance with a preferred embodiment of the invention, the inventive stadium wrap 200 includes a second layer which takes the form of a weather protection fabric 203. In accordance with the invention, fabric layer 203 overlies and is in facing relationship to inner layer 202. Layers 202 and 203 thus form opposite sides of the inventive stadium wrap 200. Weather protection fabric 203 may be any one of numerous materials which will provide protection from wind, water and other environmental conditions. For example, tightly woven parachute nylon fabric which has been treated with a waterproofing agent will effectively block wind, air leakage during movement, and water. Other fabrics that are specifically contemplated are polyurethane laminate, thermoplastic polyurethane, ripstop nylon fabric, nylon taffeta, laminated cotton, poplin, water resistant polyester fleece, treated microfiber, treated and nontreated wool, vinyl, pleather, various polymer based fabrics, plastic, and any other fabric capable of providing water resistance and wind resistance.

In accordance with a preferred embodiment, the Stadium wrap 200 includes cords similar to these described in the embodiment disclosed in reference to FIG. 1. Specifically, Stitched in between inner layer 202 and outer layer 203 are three elastic cords whose function is to allow the width of the inventive stadium wrap 200 to be varied from full width, for example 1.2 m to a smaller width substantially equal to the width of the elastic cords plus the width 115 of the inelastic portion of stadium wrap 200. More particularly, in accordance with the invention a top elastic cord 212, a middle elastic cord 213, and a bottom elastic cord 214 are provided. Top elastic cord 212 runs parallel with top longitudinal edge 204. Top elastic cord 212 lies closer to top longitudinal edge 204 than to middle elastic cord 213. Middle elastic cord 213 lies roughly in the middle of inner layer 202 and outer layer 203 and runs parallel to top longitudinal edge 204 and bottom longitudinal edge 205. Bottom elastic cord 214 runs parallel to bottom longitudinal edge 205. Bottom elastic cord 214 lies closer to bottom longitudinal edge 205 than to middle elastic cord 213. Top elastic cord 212, middle elastic cord 213, and bottom elastic cord 214 are long enough to result in stadium wrap 200 extending around and snugly gripping the user, optionally a user of very petite or skinny stature.

Figure 7:
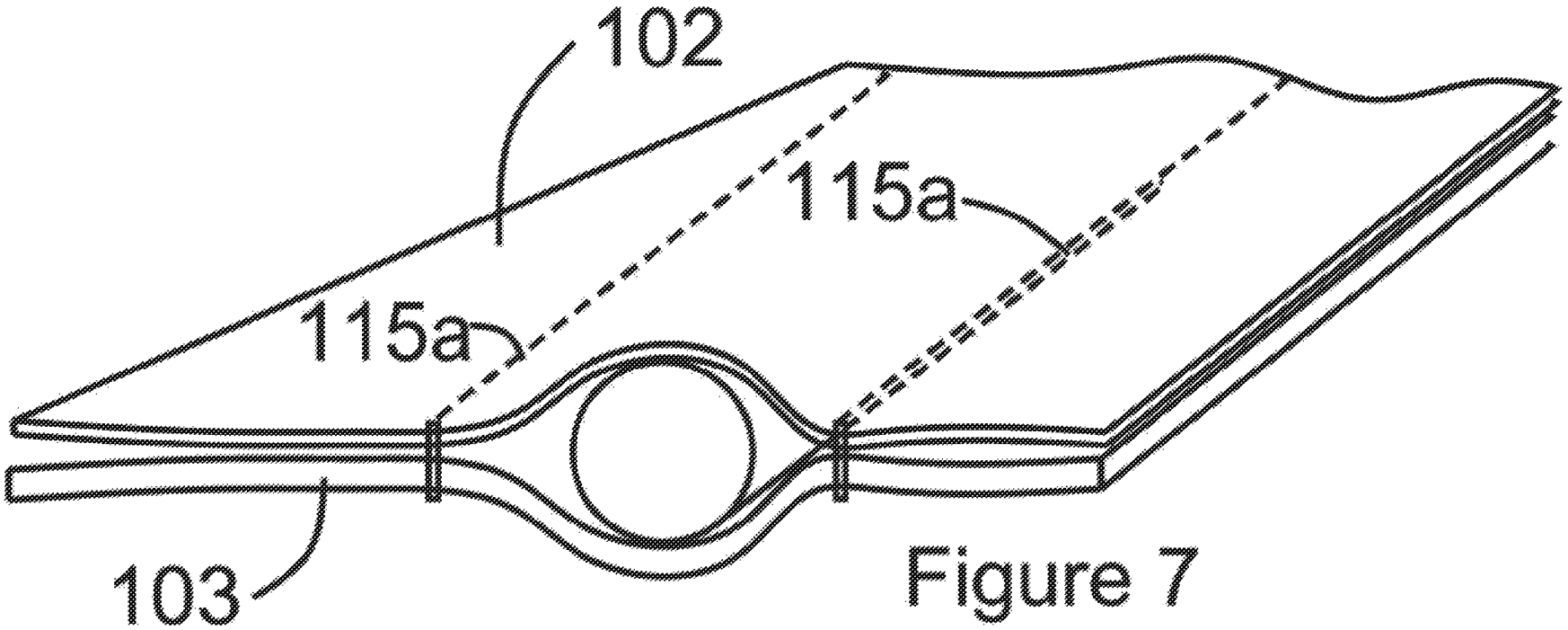
FIG. 7 diagrammatically illustrates the attachment of one of the elastic cord tensioning members for tightening the inventive protective device.

Elastic cords 212, 213 and 214 are slidably mounted within the elongated channels defined between respective facing stitching pairs, similar to the structure of FIG. 7.

Top elastic cord 212, middle elastic cord 213, and bottom elastic cord 214 are comprised of material that will elastically expand under the application of tension and contract to its original shape when the tension is released. Such elasticity is provided in order to enable the three elastic cords to secure stadium wrap 200 securely around the user. Elastic cords 212 are any diameter necessary to rest slidably within channels defined between the stitching pairs which maintain them in position in a matter similar to that illustrated in FIG. 7. Elastic cords 212 are thus held in place by respective stitching pairs similar to those illustrated in FIG. 7

The ends of elastic cords 212, 213 and 214 are secured to the inside layer 202 and outside layer 203 by tacking threads in the manner similar to the embodiment of FIGS. 1-7. Accordingly, tightly wrapping stadium wrap 200 around the body of the user puts elastic cords 212, 213 and 214 in tension.

Elastic cords 212 prevent heat loss by keeping stadium wrap 200 closer to the user. This reduces convective heat loss. At the same time, ruffles are formed, but these ruffles tend to form independent compartments and are not in substantial convective communication with the user's body, and thus act as insulative ruffle pockets.

Figure 10:
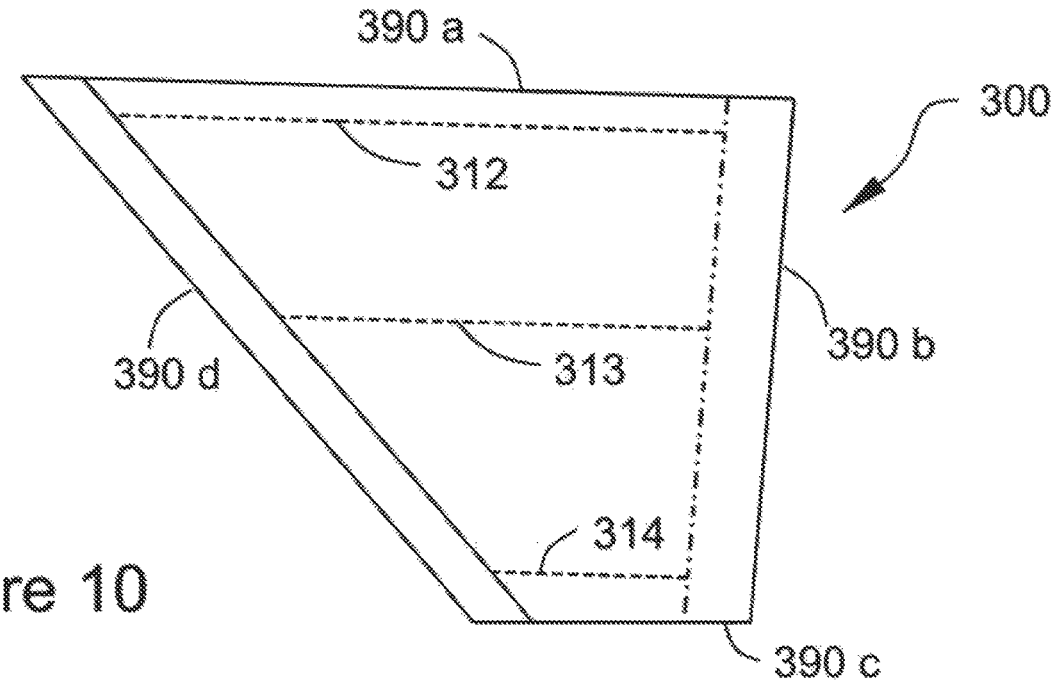
FIGS. 10 and 11 illustrate an alternative embodiment of the invention having a straight side which defines a tapered shape for accommodating the narrow girth of the legs of a user.
Figure 11:
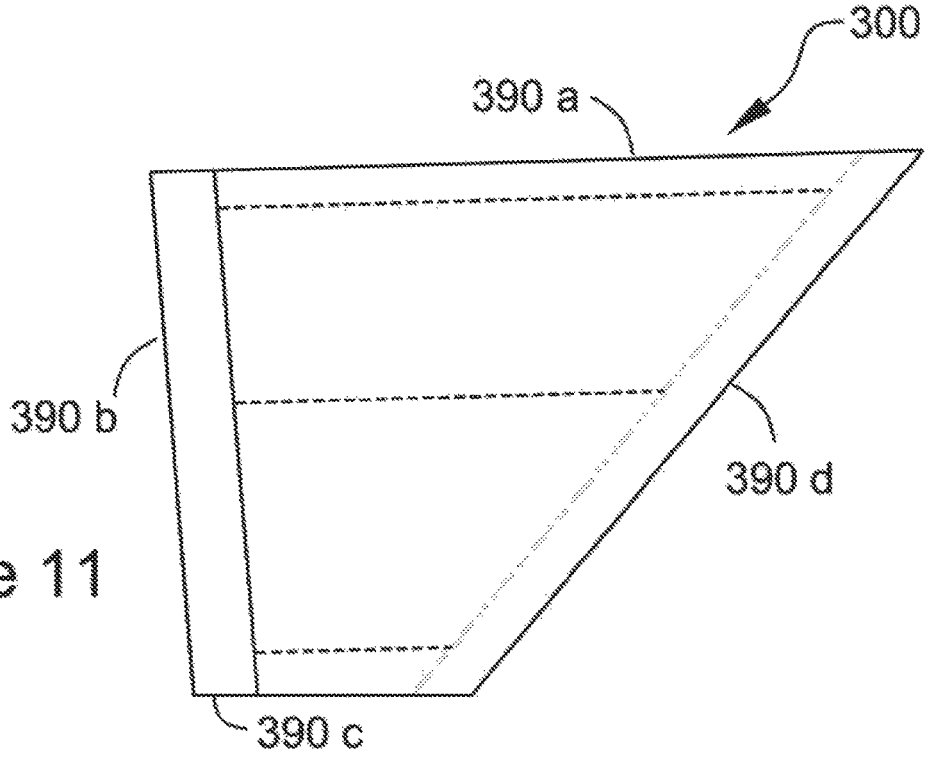

In another preferred embodiment, depicted in FIGS. 10-11, a stadium wrap 300 has a more acute shape. Stadium wrap 300 is generally comprised of sides 390*a*, 390*b*, 390*c*, and 390*d*. In this embodiment sides 390*a* and 390*c* are approximately parallel and intersect side 390*b* at approximately a right angle. Additionally, side 390*a* is longer than side 390*c*. In an exemplary embodiment side 390*a* is 47 inches and side 390*c* is 35 inches. It is additionally contemplated that sides 390*a* and 390*c* may be longer or shorter to accommodate different sizes of the stadium wrap to accommodate different sized people wearing the wrap and/or the use of the stadium wrap with other warm clothing for cold weather. For example, side 390*c* of stadium wrap may measure 28, 35, 45, or 52 inches and side 390*a* of the wrap may measure the same for all sizes or may change depending on the desired fit, by way of example side 390*a* may measure 47, 50, 60 or 70 inches.

Further, side 390*d* is configured to connect the longer side 390*a* to the shorter side 390*c*. 390*d* is optionally a straight line from 390*a* to 390*c* making the angle of the fabric less than 90 degrees. The shape of side 390 *d* is designed to be bigger at the waist and smaller at the ankles, corresponding with the general anatomy of a person. As such, angle of the relationship between side 390*a* or 390*c* and 390*d* may change based on the size of the stadium wrap.

A feature in at least one embodiment according to the above descriptions is a multi-use pocket. The pocket may be configured to be accessible while the stadium wrap is closed and store the stadium wrap while not in use. In some embodiments the pockets are small and designed to hold everyday items, such as car keys, wallet, money clip, cell phone. Alternatively, the pocket is designed to be turned inside out and thus allow the wrap to be contained in the pocket for easy storage and transport.

The stadium wrap is designed such that the material wraps around the waist of the wearer. The wearer then uses the closing mechanism to attach the material to itself. Then, the wearer does this down their body until the stadium wrap is fully connected on itself. This is done depending upon on the preference and tightness of the stadium wrap against the wearer's body.

Referring to FIGS. 10 and 11, the wearer can begin to put on the inventive wrap by placing the wrap behind themselves. Then, the wearer wraps side 390*a* around themselves and brings fastener material adjacent side 390*d* into engagement with fastener material adjacent side 390*b*.

Figure 12:
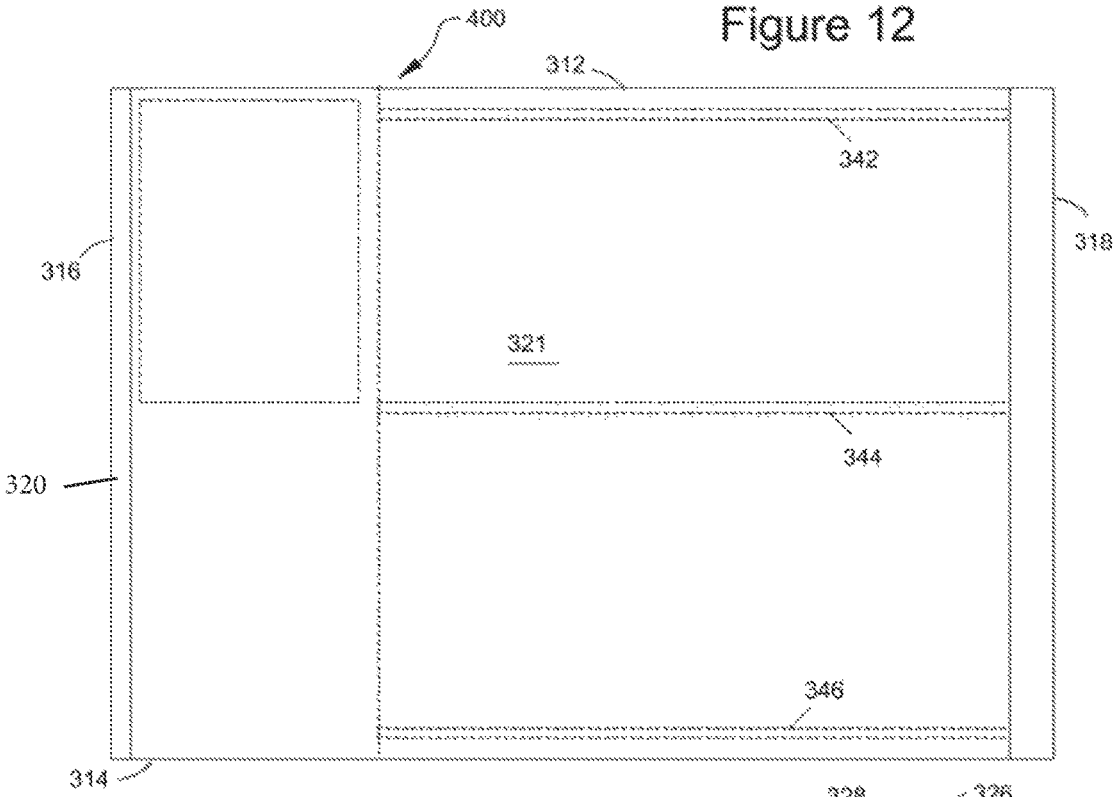
FIGS. 12 and 13 illustrates an alternative rectangular configuration for the inventive wrap including means to hike up corners of the wrap for ventilation and movement.
Figure 13:
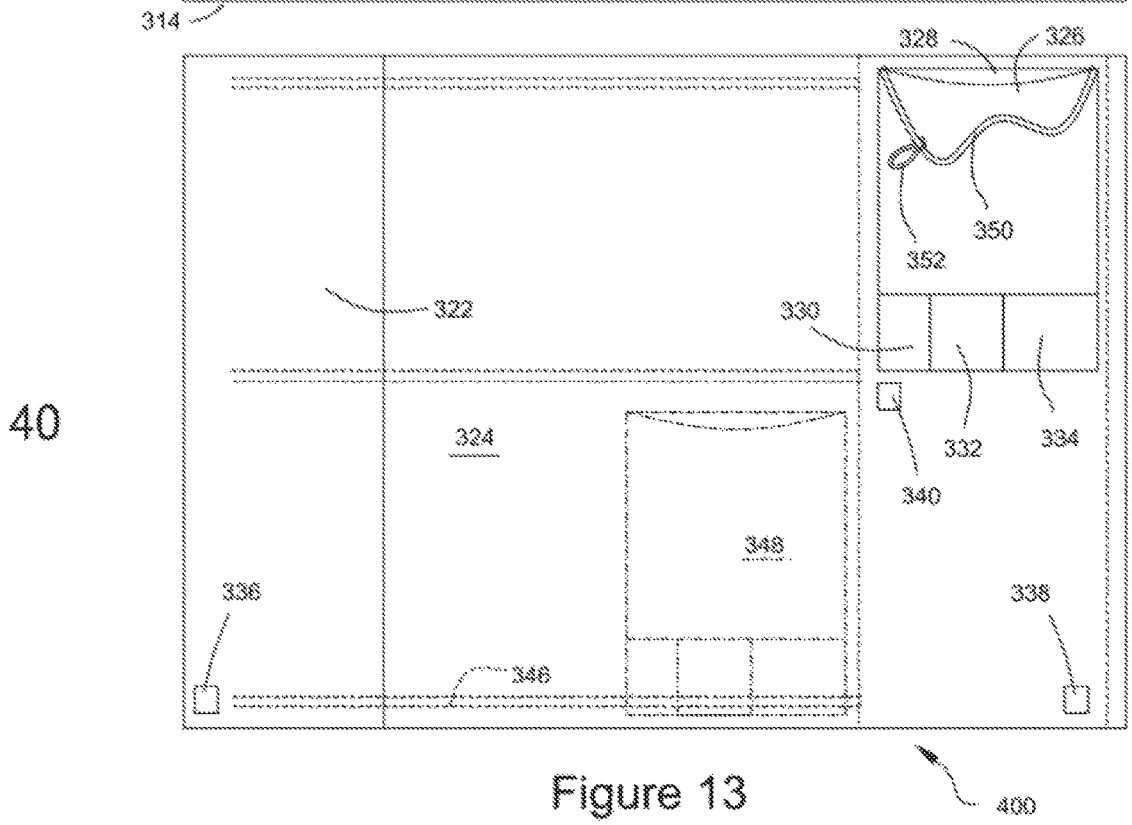

In another preferred embodiment, depicted in FIGS. 12-13, a stadium wrap 400 with a rectangular shape, multiple pockets and a carabiner holding cord is illustrated. Stadium wrap 300 has four sides, namely the top side 312, a bottom side 314, the left side 316 and a right side 318. In an exemplary embodiment sides 312 and 314 are 56 inches long, and sides 316 and 318 are 40 inches in length. An elongated Velcro® type member 320 has a width of approximately three quarters of an inch is secured to the inside surface 321 of wrap 300 (made of fleece or any other insulative material), while a mating 13 inch wide mating hook and loop fastener member 322 is secured to outside surface 324, as illustrated in FIG. 13.

Two large pockets 326 and 328 are provided. Smaller pockets 330, 332 and 334 of varying sizes complete a five pocket arrangement. Optionally, one of the pockets, for example a small pocket may be close with a zipper for security.

To provide for ventilation, a pair of blue type fastener patches 336 and 338 are provided and which mate with a hook type fastener patch 340 to provide for ventilation by folding up the corner of the inventive wrap 300. As in the above embodiments, visiting members 320 and 322 are brought into contact with each other to close the wrap. Varying levels of ventilation may be achieved by having different lengths closed. This also provides for movement.

Elastic cords 342, 344 and 346 which had unstretched length of 20 inches are provided to span the 40 inches between the edge of loop fastener member 322 and site 318. Optionally, cord 342 may be separated from cord 344 by seventeen inches. One or more additional pockets 348, of various designs, may be provided on the outside surface of the inventive wrap 300.

Optionally, a cord carrying handle 350, dimensioned to hang on the shoulder of the user, may be provided adjacent inner pocket 328, and provided with a carabiner 352 for easy carrying, for example on the belt of the user, or clipped to a backpack. In order to stow the inventive blanket, inner large pocket 328 is turned inside out and the protruding portions of the blanket are neatly folded and positioned inside pocket 328. Alternatively, carabiner 352 may be used to carry the user's keys.

Figure 14:
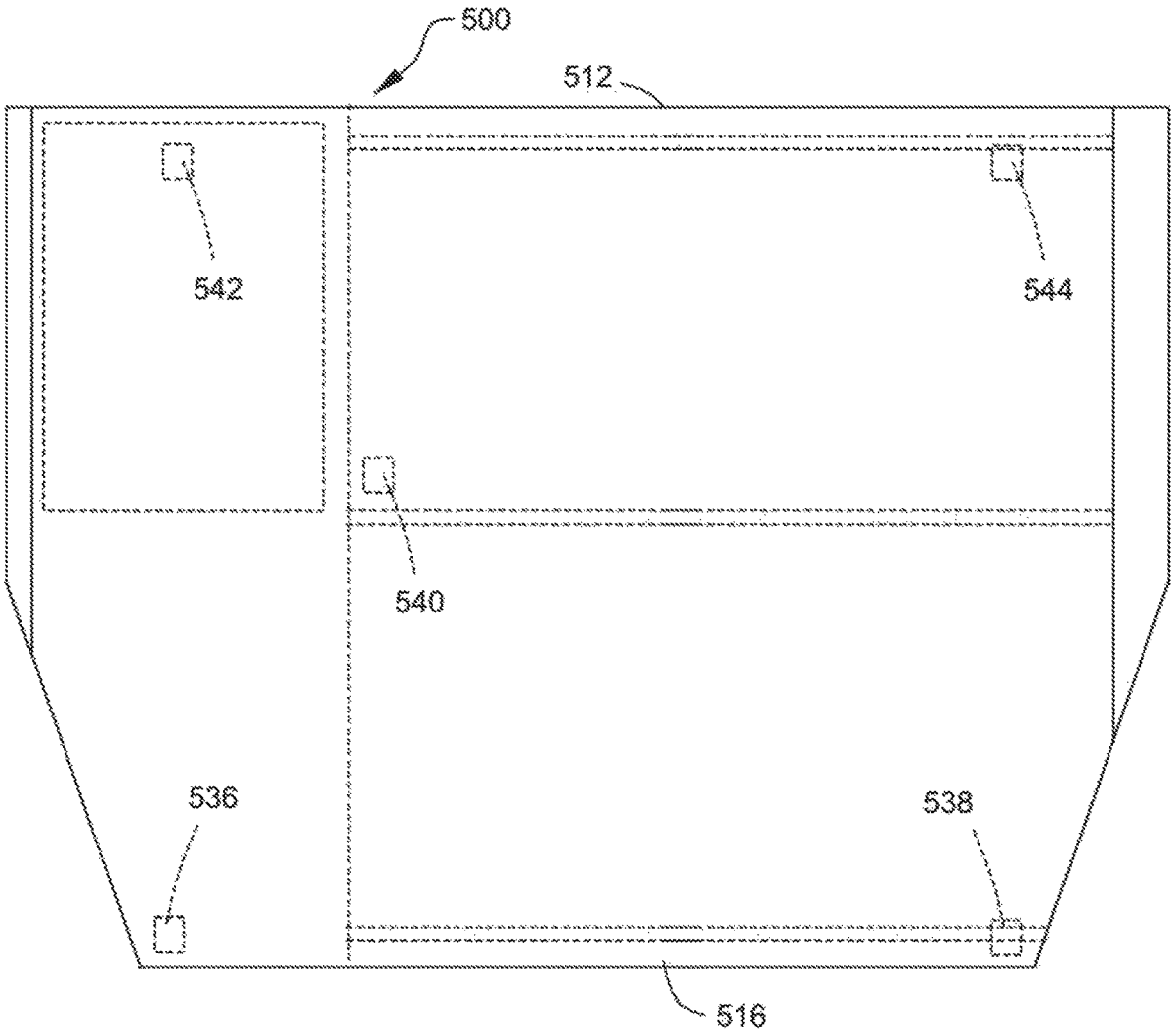
FIG. 14 is a plan view of an alternative embodiment of the invention having chamfered corners to accommodate smaller girth around the ankles.

An alternative embodiment of the inventive stadium wrap 500 is illustrated in FIG. 14. This embodiment is substantially identical to the embodiment illustrated in FIGS. 12 and 13 except that its width 512 is reduced to 54 inches, and the lower corners of the material have been removed up to a height of 18 inches to better accommodate the smaller width needed about the ankles. In this embodiment the reduction in width is taken out of the elastic portion of wrap 500. Accordingly, the top and middle cords are reduced in length by one inch. Likewise, the bottom cord is reduced in length. The lights of the cords are selected in such a manner that they stretch to twice there unstretched length. The narrow with needed around the feet is accommodated by the two chamfered bottom corners. In accordance with the preferred embodiment, bottle edge 516 is 42 inches long.

In a manner similar to the embodiment of FIGS. 12-13, a corner retaining patch of hook fastener material 540, and mating corner patches of loop fastener material 536 and 538 may be provided to allow a corner of the wrap 500 to be pulled up for freedom of movement and/or ventilation.

Similarly, additional patches of hook material 542 and 544 may be provided to allow the entire bottom of the inventive wrap to be pulled up and secured at the waist, thus reducing its height by about fifty percent.

Figure 15:
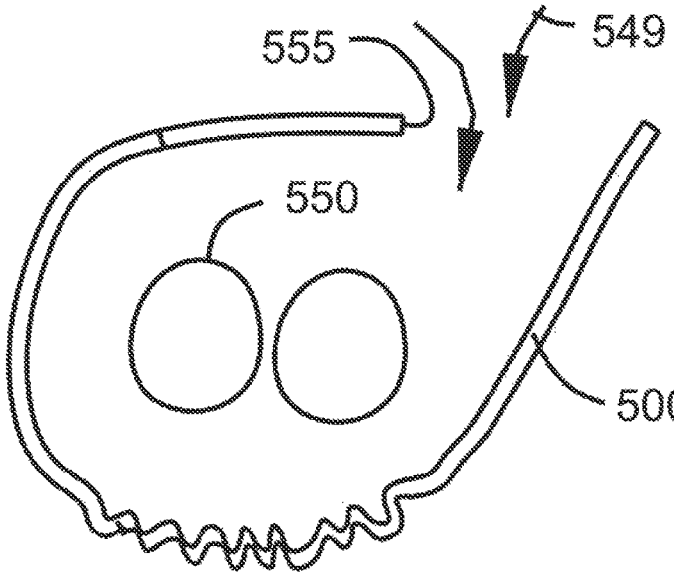
FIGS. 15 through 17 schematically illustrate in cross-section three alternative arrangements for wearing the inventive wrap.
Figure 16:
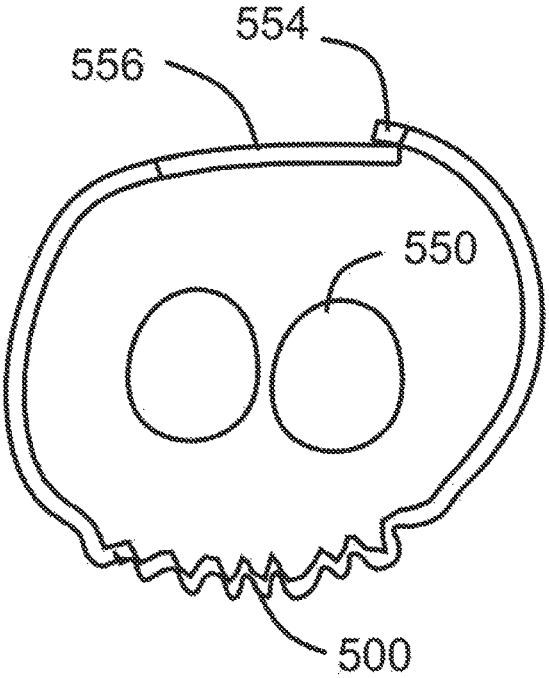
Figure 17:
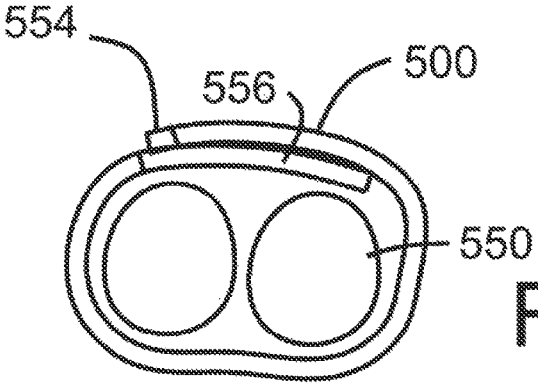

The functioning of the present invention may be understood with reference to FIGS. 15 to 17. More particularly, FIG. 15 is a schematic representation of the inventive stadium wrap 500 loosely open over a portion of its length, for example from the waist to the ankles. This allows air 549 to freely circulate around the legs 550 of a user. Referring to FIG. 16, the wrap may be closed along its entire length but loosely by, for example, adhering narrow 1 inch wide hook material strip 554 to the edge 555 of stadium wrap 500, by engaging the edge of 12 inch wide loop attachment material strip 556, optionally along the entire length of the stadium wrap. This results in closing out the air but leaving some space in between the user's legs 550 and the inside of wrap 500, thus allowing some circulation of air. Referring to FIG. 17, the inventive wrap 500 may be wrapped tightly around the legs 550 of the user, substantially eliminating the space for the circulation of air. This configuration may be secured in place by 1 inch wide hook material strip 554 being placed in engagement with loop material 536 at the inside edge of loop material 566.

Optionally, a loop fabric patch may be provided on the outside of the inventive wrap 300, which may be used to receive mating patches, for example advertising material, and the like, such as a favorite team logo.

In accordance with the invention, the elastic cords may be provided with adjustments. The wearer may then adjust the elastic cords to tighten around their body creating insulating ruffles were the material is close to the surface of the body between cords that are next to the surface of the body. These pockets are effective for keeping air that is warmed by body heat.

As an alternative to elastic cords, one or more of the fabric members, may be made in whole or in part from a textile fabric incorporating elastic fibers, yarns or the like.

In addition, it is possible to use the stadium wrap of the present invention by securing it only adjacent the top of the wrap, proximate to the waist of the user.

Additional modifications to each of the preferred embodiments are contemplated at the time of the disclosure. One of these include varied number of elastic cords. The elastic cords may be used to secure wrap around the waist, knees, and ankles or may include a variation of these locations, for example around the waist and ankles only or around the waist and knees only. Further, the wrap may include a relatively large number of cords disposed across the full height of the inventive wrap. This configuration may increase the versatility of the wrap and increase the ability to wear the wrap while walking by accommodating different stride lengths, for example where a relatively large amount of length is provided adjacent the legs of the wearer.

Additionally, such a structure may allow the wrap may vary in width to accommodate various sized people and additional clothing in the colder months. Alternatively, the widths may correspond with general clothing sizes in inches or slightly bigger. Further, the wrap may come as a one size fits most. Another variation may be the length of the wrap. The wrap my come in several lengths to accommodate people of different heights including petite, regular, and tall variations. In addition, while the above disclosure illustrates the invention with reference to a wrap which extends from the waist to the ankles, the length of the wrap may be varied in accordance with the invention, for example, it may extend from the ankles to under the the armpits or even up to the chin or even eyes of the person wearing it. Such variation may be selected as a matter of comfort, weather, convenience, aesthetic appearance or any other factors deemed important by the user.

It is also understood that many different types of fasteners may be used in addition to hook and loop fasteners. These may include steps, clips, buttons and so forth.

Figure 18:
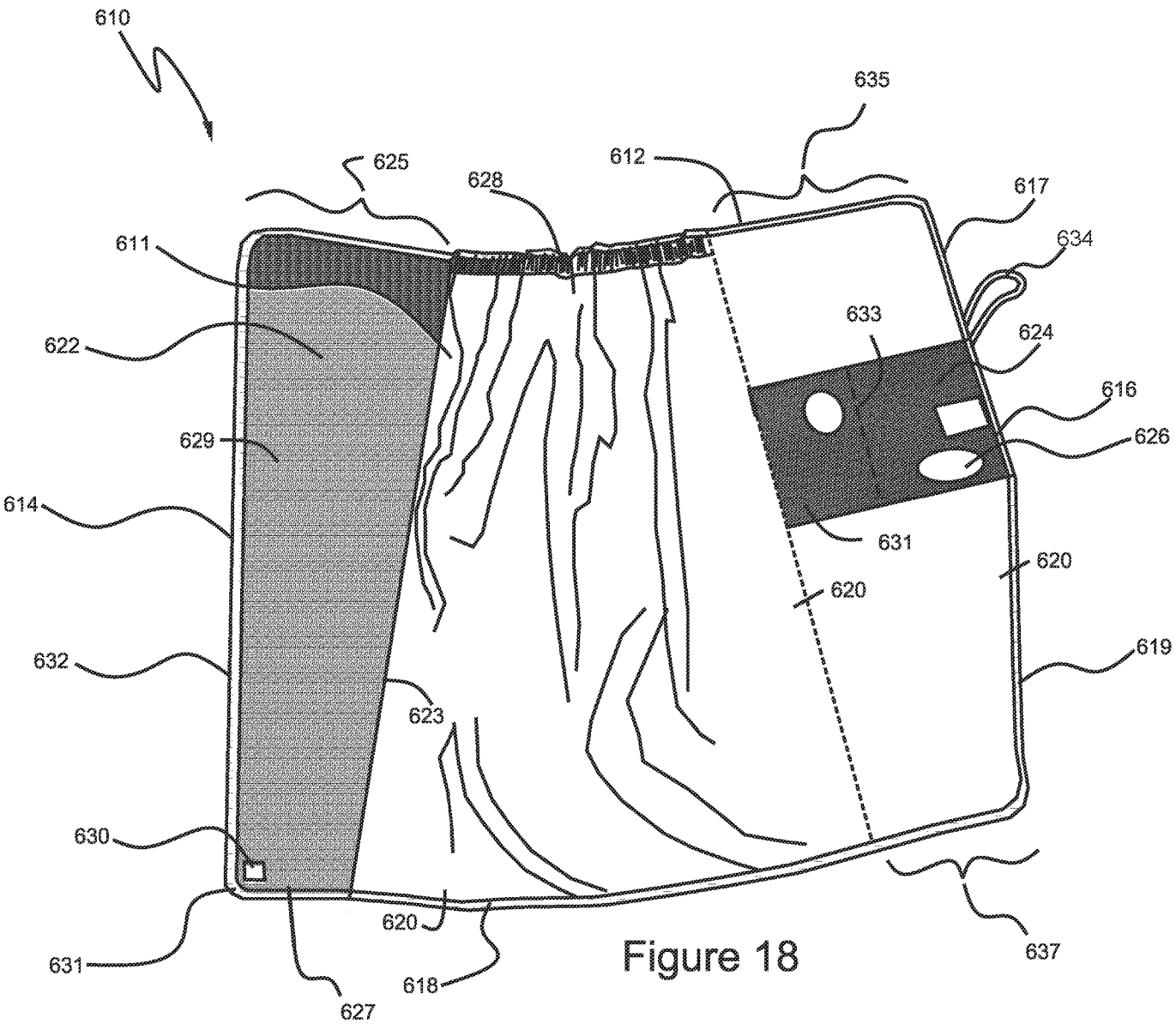
FIG. 18 illustrates the exterior of an alternative embodiment of the inventive wrap in plan view in an unstretched state.

An alternative embodiment of the present invention is illustrated in FIG. 18. Similar to the embodiments of the invention illustrated above, protective wrap device 610 is made from fabric members which are secured to elastic members which crumple and compress protective wrap device 610 into a smaller unstretched state. This allows protective wrap device 610 to be stretched and secured around the body of the wearer.

At the same time the overall shape and size of protective wrap device 610 allows the formation of a wrap which generally allows it to be extended around individuals with a large range of body measurements. Larger dimensions are provided to accommodate larger body portions (generally corresponding to the midsection/stomach (or alternatively the upper body and chest) which are, on average larger than other parts of the body, with elasticity provided to accommodate individual variation. Smaller dimensions are used in the parts of the protective wrap device which extend around the smaller lower body portion where variations in human body size are smaller, with overall size being matched to average body portion size.

FIG. 18 is an exterior plan view of the alternative embodiment, showing protective wrap device 610 in the unstretched configuration. In this embodiment, protective wrap device 610 defines an exterior surface 611. Protective wrap device 610 has a top edge 612, a first side edge 614, a second side edge 616, and a bottom edge 618. Second side edge 616 has a straight portion 617, and tapered portion 619. Top edge 612 is adjacent what may be referred to as the waist portion 613 of inventive wrap device 610. Likewise, what may be referred to as ankle portion 615 is positioned adjacent bottom edge 618. A knee portion 621 lies between waist portion 613 and ankle portion 615.

The exterior surface 611 of protective wrap device 610 is defined on an outer protective layer 620 made, for example, of a water-resistant nylon fabric, or other waterproof water resistant material. Protective wrap device 610 comprises a wide tapered panel with loop connection material 629. Alternatively, wide tapered panel 622 can alternatively be hook connection material. Wide tapered panel 622 extends from the top edge 612 to the bottom edge 618. Wide tapered panel 622 extends from first side edge 614 to a seam 623 at which wide tapered panel 622 is joined to outer protective layer 620.

Wide tapered panel 622 has a width 625 of about thirteen inches at the top edge 612. Alternatively, width 625 may have other dimensions, for example in a range between eight and sixteen inches, most preferably between 11 and 14.5 inches. Wide tapered panel 622 extends from first side edge 614 with a width 627 of about six inches at bottom edge 618. Alternatively, width 627 may have other widths, for example in a range between three and nine inches, more preferably 5 to 7 inches. Edge section 635 is about fourteen inches long. Edge section 637 is about nine inches long in accordance with the preferred embodiment.

As noted above, wide tapered panel 622 may constitute a separate member which is joined at seam 623 to outer protective layer 620, made of, for example, waterproof nylon. Alternatively, outer protective layer 620 may be divined by a single member comprising a sheet of waterproof material defining the areas of outer protective layer 620 and tapered panel 622. In this alternative embodiment, sheet of loop material having generally the shape illustrated for wide tapered panel 622 in FIG. 18 may be secured by stitching to such a single member of waterproof material.

Returning to the embodiment illustrated in FIG. 18, seam 623 joins separate tapered panel 622 and water resistant outer protective layer 620.

Wide tapered panel 622 can be waterproof, providing an all-around water proof outer layer. Alternatively, wide tapered panel 622 can be water resistant or water permeable, and the waterproofing can be achieved, in use, by placing second side edge 616 over all or most of wide tapered panel 622 when wrapped around the user and worn by a user. Protective wrap device 610 further comprises a pocket panel 624 over water resistant outer protective layer 620. pocket panel 624 is made of, or covered by, loop connection material with loops 631. Pocket panel 624 as depicted, comprises two pockets formed by stitching 633, an accessory loop 634 near pocket opening, and a rubber sewn in logo 626.

Near top edge 612 of device 610 there is a crumple zone 628 where excess material bunches up when protective wrap device 610 is in an unstretched state. This is achieved through the use of an elastic band 654 (FIG. 19), much like the elastic waistband of sweatpants as is described more fully below.

A small patch of hook material 630 is positioned near a corner formed by first side edge 614 and bottom edge 618. Protective wrap device 610 includes a binding type edging 632 running substantially continuously around the periphery of protective device 610, along top edge 612, first side edge 614, second side edge 616, and bottom edge 618.

Figure 20:
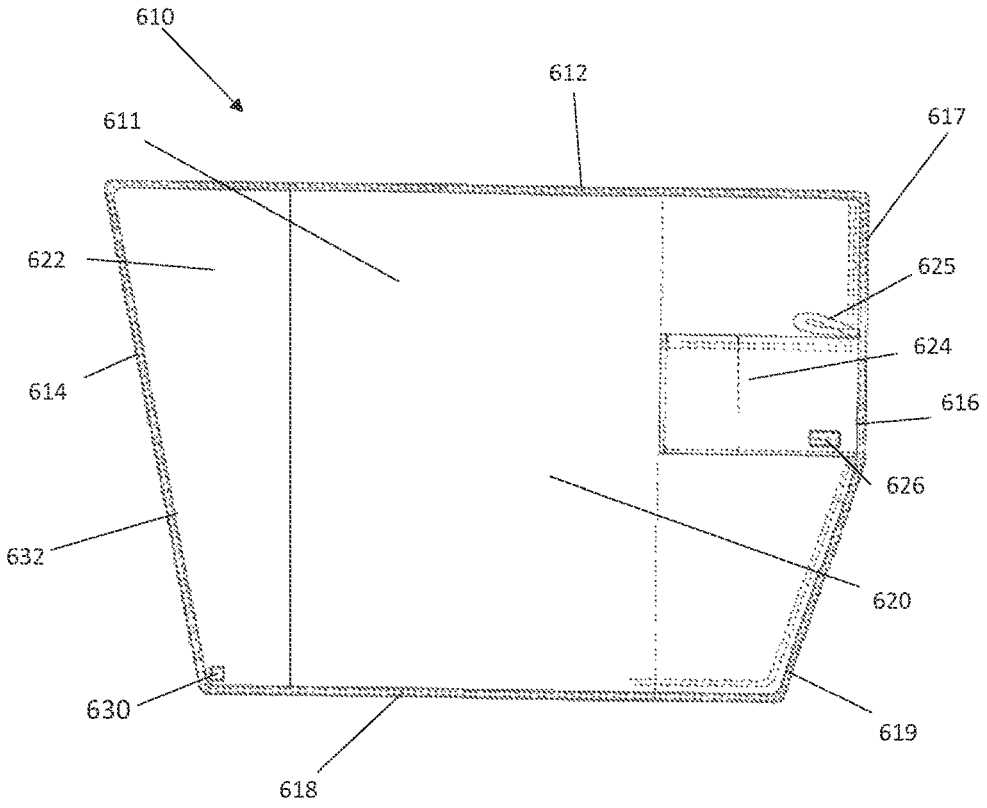
FIG. 20 is an exterior plan view of the embodiment of the inventive wrap of FIG. 18 in a fully stretched state.
Figure 21:
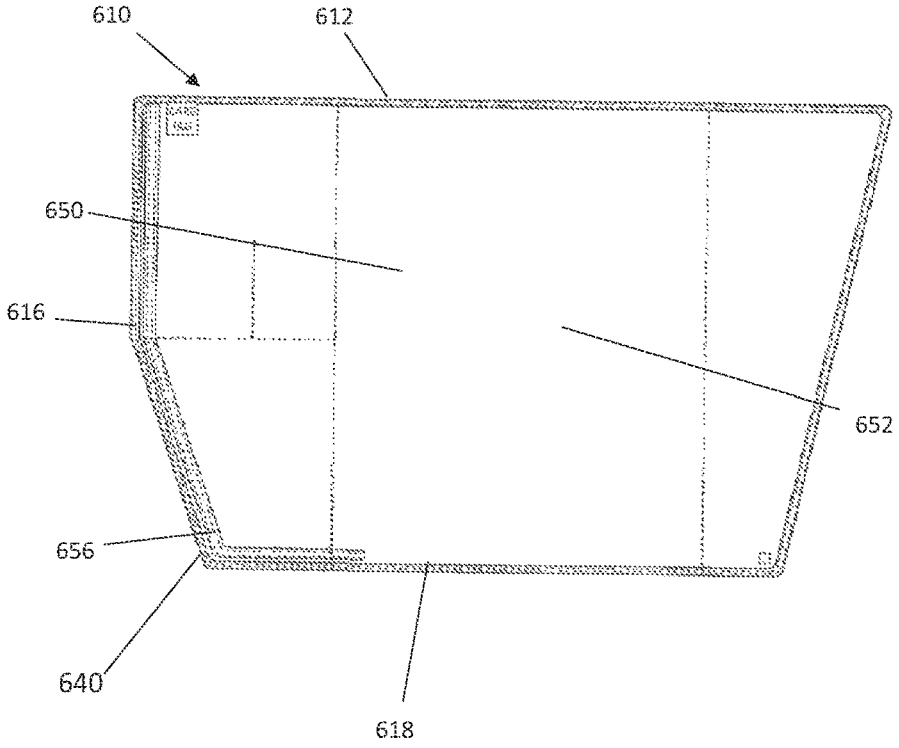
FIG. 21 is an interior plan view of the embodiment of the inventive wrap of FIG. 18 in a fully stretched state.

In its unstretched state, top edge 612 measures about 44 inches from corner to corner (for example in the range between 40 and 49 inches), while in stretched state top edge 612 measures about 58 inches from corner to corner, for example in the range between 52 and 66 inches. As is apparent from the above, the fully stretched top edge width of about 58 inches is the same as the width of the top edge of the fabric used to form outer protective layer 620. In both the unstretched and stretched state, bottom edge 618 measures about 44 inches from corner to corner, which again corresponds to fabric edge width. A fully expanded device 610 is depicted in FIGS. 20 and 21.

Referring back to FIG. 18, first side edge 614 measures about 39 inches (for example in the range between 32 and 44 inches). Straight portion 617 of second side edge 616 measures about 19 inches (for example in the range between 17 and 23 inches), and tapered portion 619 of second side edge 616 measures about 20 inches (for example between 17 and 23 inches).

Figure 19:
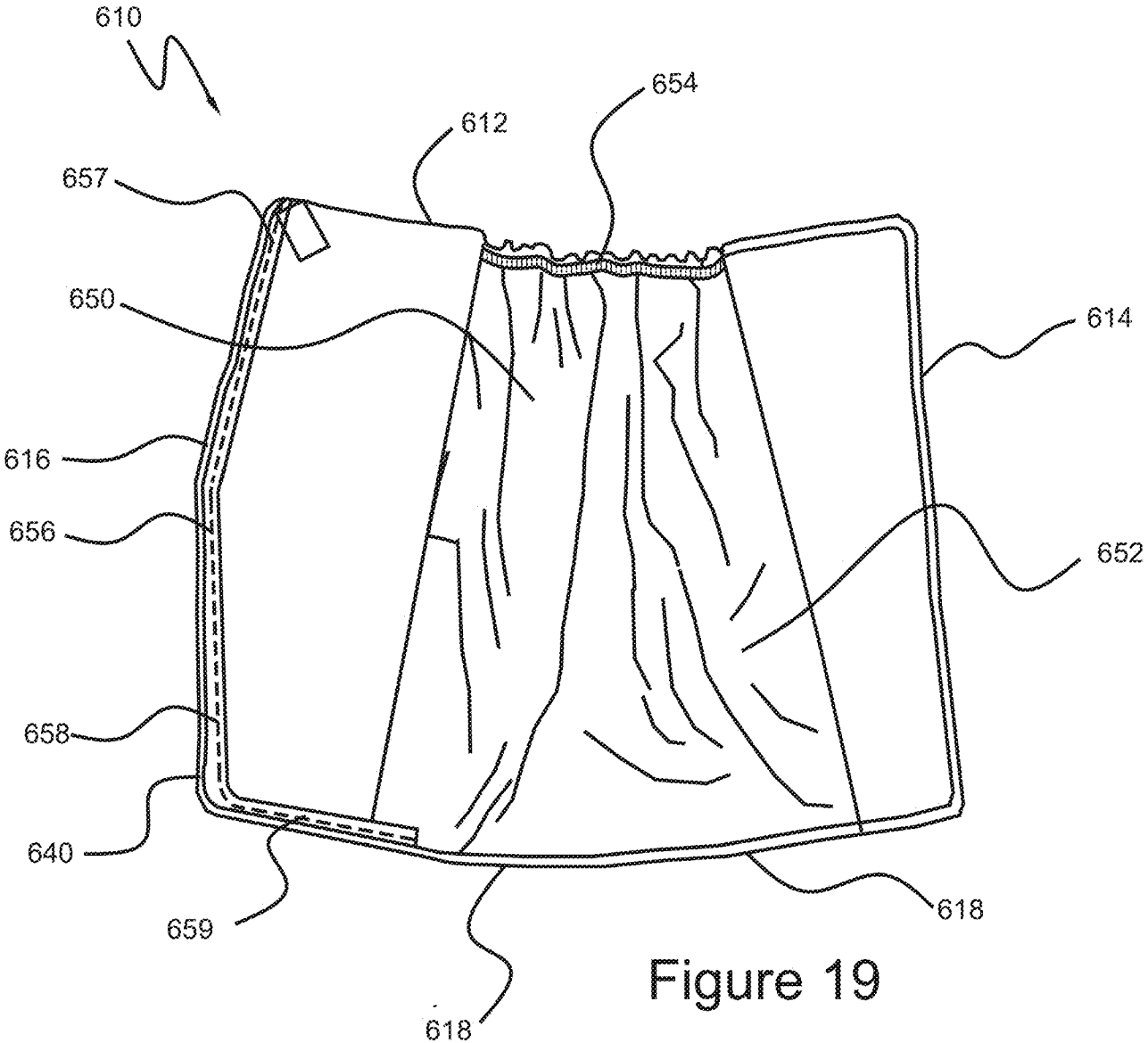
FIG. 19 illustrates the interior of the embodiment of the inventive wrap of FIG. 18 in plan view in the unstretched state.

FIG. 19 shows the interior of the protective wrap 610 of FIG. 18 in its unstretched state. Protective wrap 610 has an interior fleece surface formed by an inner insulative layer 652 made of a fleece-like material. Inner insulative layer 652 is sewn to water-resistant nylon fabric outer protective layer 620.

Elastic band 654 is sewn onto interior surface 650 of protective wrap 610 at a location near top edge 612, preferably at a central region, but can be located closer to a side edge. Elastic band 654 has a length of about 16 inches when in its unstretched state, and up to about 29 inches when stretched (for example between 26 and 33 inches). Elastic band 654 can be, but is not limited to, a knitted, woven, braided elastic material, or other elastic materials such as the kind used in underwear. Elastic band 654 is sewn onto interior surface 650 via two rows of stitching across its length and spanning from end to end longitudinally, and additional stitches at the ends running transversely. Elastic band 654 can be sewn in between protective waterproof layer 620 and inner insulative layer 652, or located external to the layers described. Elastic band 654 can span the full width of protective device 610 or any measurement therebetween.

Inner insulative layer 652 supports a hook material strip 656 running along second side edge 616 near edging 632 which mates with wide tapered panel 622. Hook material strip 656 extends from top edge 612 along second side edge 616 to bottom edge 618 and continues along bottom edge 618 for some distance, in this embodiment about 12 inches along bottom edge 618. In this embodiment there is a vertical section 657 of hook material strip 656, a diagonal section 658 of hook material strip 656, and a horizontal section 659 of hook material strip 656. Vertical section 657 of hook material 656 runs vertically about 19 inches down and along straight portion 617 of second edge 616, measuring about 20 inches. Diagonal section 658 of hook material strip 656 runs along tapered edge portion 640 of second edge 616 spanning about 19 inches. Horizontal section 659 of hook material strip 656 runs across bottom edge 618, spanning about 12 inches. Alternatively horizontal section 659 can be longer or shorter, such as running across the full width of protective wrap 610, or not running across bottom edge 618, and only having a hook material strip running down protective wrap 610 from top edge 612 down part of the way or all of the way to bottom edge 618. Hook material strip 656 can be a combination of strip segments attached near one another, with or without gaps, operating as one continuous strip, for instance, a first strip running down and a second strip running across. Protective wrap device 610 includes tapered portion 619 for providing multiple additional functions and features. Hook material strip 656 on interior surface 650 can be engaged with wide tapered panel 622 by overlapping second side edge 616 of interior surface 650 over first side edge 614 and attaching hook material strip 656 on interior surface 650 to wide tapered panel 622 on exterior surface 611.

Due to wide tapered panel 622 being wider than hook material strip 656, hook and loop materials can be engaged with one another at different locations and orientations. In this way, the user can choose how protective wrap device 610 wraps around the user. The user can choose how tight or loose they prefer to have protective wrap device 610, which is assisted by elastic band 654.

Protective wrap device 610 can take a conical or tubular shape, or a variation thereof such as conforming to a human body, depending on the attachment orientation of the hook and loop material. A user can attach individual sections of hook material strip 656 to wide tapered panel 622 without attaching other sections, such as vertical section 657, diagonal section 658, horizontal section 659, or a combination thereof. For instance, vertical section 657 of hook material strip 656 can be attached to wide tapered panel 622, forming an almost tubular shape with a split. The split is formed by diagonal section 658 combined with the taper of first side edge 614. A split can be formed without first side edge 614 being tapered as well since second side edge 616 includes a tapered portion 619, and vice versa. At this point the split can be closed by attaching diagonal section 658 and optionally horizontal section 659 to wide tapered panel 622.

A split or gap at the bottom can assist in walking or comfort in orientation of the user's legs. Furthermore, a small patch of hook material 630 is provided on wide tapered panel 622 proximate a bottom corner 631. small patch of hook material 630 can be attached to any portion of the wide tapered panel 622. In particular, small patch of hook material 630 can be engaged to hitch up bottom corner 631 to create a gap, allowing for more room for the user's feet, to assist in walking or comfort while using protective wrap device 610.

Horizontal section 659 can selectively be attached as well to allow the tightening of the lower portion of protective wrap device 610, closing off air flow intake via the bottom of inventive protective wrap device 610.

Alternatively, protective wrap device 610 can be worn very loosely and have a large gap running most of the way up inventive protective wrap device 610 by limiting the connection to only the top portion of the wide tapered panel, where a corner would be the only manner of securing inventive protective wrap device 610 in place providing a large split running approximately from the top of protective wrap device 610 all the way down.

FIG. 20 shows an exterior plan view of the alternate embodiment of FIG. 18 in a fully stretched configuration. FIG. 20 shows protective wrap 610 without elastic band 654 illustrated allowing for clearer understanding of the structure. The embodiment of FIG. 18, which includes elastic band 654, can be stretched fully and to the same extent as illustrated in FIG. 20 in that elastic band 654 provides enough stretch to reach the full width of the material it is attached to or embedded within.

A user grips both sides or edges, wrapping protective device 610 around themselves. In doing so the user stretches protective wrap device 610 via elastic band 654 and overlaps second side edge 616 having hook material strip 656 over wide tapered panel 622, connecting hook material strip 656 to wide patch of loop material 622. If enough tension is selected, this results in protective wrap device 610 being held in place on the user's body, at the size and tension selected by the user, controlled by the position of the hook and loop connection location. A user can, among other things, select a loose or tight fit, or a variation thereof, adjust gap size of the overlapped portions, select tightness around the feet, and whether to hitch up a corner.

FIG. 21 shows the interior stretched plan view of the alternate embodiment of FIG. 18 in a fully stretched position and again without elastic band 654, for illustrative purposes.

Protective wrap device 610 provides protection for a user against harsh temperatures and weather, while also providing comfort and ease of use. Outer protective layer 620 provides water and wind resistance, preventing a user from getting wet during rain, and breaks wind during windy weather. Uses include but are not limited to in stadiums, outdoor venues, ice skating rinks, at the field, in the snow, at concerts, in the backyard, at a campsite, in an office, at a fire pit, in the mountains, boating, and travel.

Wide tapered panel 622 provides for an easier mating of the connection materials. Having a wide patch of connection material facilitates the ability to adjust the sizing of the protective wrap 610 based on a user's size and preference. The wide patch of wide tapered panel 622 includes tapered measurements as it moves down protective wrap device allowing for a gap to be formed when the inventive device is closed part of the way, for comfortable walking and venting. crumple zone 628 reduces excessive clumping of material, rather there is a continuous and substantially even folding of excess material along the width of the elastic band 654 area.

Edging 632 provides a finished edge making protective wrap device 610 comfortable for the user. Accessory loop 634 can be used for attaching articles such as but not limited to a carabiner. Pocket panel 624 includes loop material which can be used for attaching to parts of the device or other hook material covered articles such as decals, patches, or other detachably attachable components using hook material.

Although the present invention has been described with reference to preferred embodiments, numerous modifications and variations may be made within the scope of the invention, which is limited and defined only by the appended claims. No limitation with respect to the embodiments disclosed herein is intended or should be inferred.

The invention claimed is:

1. A protective wrap device for maintaining body temperature in a human user, the protective wrap device comprising:

(a) a unitary member comprising:

(i) a first sheet member portion having a height and a width, the first sheet member portion comprising a left portion on the left side of said width and a right portion on the right side of said width, and having a first edge at the left of said first sheet member portion and a second edge at the right of said first sheet member portion, wherein said first sheet member portion is thermally insulative;

(ii) a second sheet member portion having a height and a width, said second sheet member portion comprising a left portion on the left side of said width and a right portion on the right side of said width, and having a first edge at the left of said second sheet member portion and a second edge at the right of said second sheet member portion, said second sheet member portion overlying at least a portion of said first sheet member portion, wherein said second sheet member portion is waterproof or water resistant, said first sheet member portion being connected to said second sheet member portion, said first sheet member portion and said second sheet member portion together forming a unitary insulative and waterproof or water resistant unitary member, said unitary member having a top edge and a top portion proximate said top edge, said unitary member having a bottom edge and a bottom portion proximate said bottom edge, said unitary member having a first edge and a second edge, and said unitary member having a front side defined by said second sheet member portion and a reverse side defined by said first sheet member portion;

(b) a middle portion disposed between said top portion and said bottom portion, said unitary member defining first and second side edges extending in the direction from said top edge and said bottom edge, said bottom edge being substantially smaller than said top edge, said first side edge gradually tapering the width of the planar member in the direction toward said bottom edge, said second side edge extending substantially transverse to said top edge for a distance between 40 and 60% of the distance between said top edge and said bottom edge in a non-tapering fashion adjacent the top portion and a portion of the bottom portion, and said second side edge extending toward said bottom edge of said protective wrap device with an orientation which results in tapering the width of the protective wrap device in the region between the middle portion and the bottom of the bottom portion;

(c) an elastic member, said elastic member having two ends, said elastic member being secured proximate each of its ends to the unitary member, said elastic member having an unstretched length and a stretched length, said elastic member being disposed proximate to said top edge of said unitary member, said elastic member being secured to said unitary member, and said elastic member extending along at least a portion of the length of said top edge of said unitary member, wherein the unstretched length of said elastic member is smaller than the length of the top edge of said unitary member, and wherein the elastic member, when stretched, overlies the top edge of the unitary member, whereby when the elastic member is unstretched, the top edge of the unitary member is gathered to have a reduced length substantially the same as the unstretched length of the elastic member, wherein the elastic member is secured to the unitary member in a manner that provides enough material to allow the elastic member to stretch, and when the elastic is stretched, the secured material unfolds to match the length of the elastic member;

(d) a first connection member positioned on said unitary member and disposed on one of said sides of said unitary member, said first connection member in the area proximate the bottom edge of the unitary member comprising loop connection material that extends vertically along the first edge and is secured at points proximate the top edge and proximate a mid point, said mid point being between said top edge and said bottom edge of said unitary member, and wherein the first connection member is wider at the top edge than at the bottom edge, and wherein the first side edge has a tapered edge extending from the top edge to the bottom edge;

(e) a second connection member positioned on said unitary member and disposed on an opposite side of said unitary member, wherein the second connection member extends vertically at least along that portion of the second edge proximate the bottom edge of the unitary member, wherein said second connection member comprises hook connection material.

2. A protective wrap as in claim 1, wherein (f) And further comprises a vertical portion, a horizontal portion, and a diagonal portion;

(g) a third connection member positioned proximate a corner of the front side of said unitary member, said third connection member mating with said first connection member, said third connection member being positioned to hitch up said corner when said third connection member is in mating engagement with said first connection member and comprising hook connection material;

wherein the first connection member and the second connection member connect to each other to form a wrap structure having an upper opening and lower opening, said first and second connection members being self-releasable, opening in response to pressure from the user's legs during walking, wherein the width at the top portion is larger than the width at the bottom portion, and wherein the elastic member provides stretch in response to force and substantially prevents or reduces the likelihood that the first connection member and the second connection member disconnect at points proximate the top edge while walking.

* * * * *